US010308390B2

(12) United States Patent
Oh et al.

(10) Patent No.: US 10,308,390 B2
(45) Date of Patent: Jun. 4, 2019

(54) CORRUGATED PACKAGING BOX

(71) Applicant: SAMSUNG ELECTRONICS CO., LTD., Suwon-si (KR)

(72) Inventors: Woo-Seok Oh, Bucheon-si (KR); Bong Sup Lim, Suwon-si (KR); Ji-won Lee, Suwon-si (KR); Hyun Jun Jung, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 265 days.

(21) Appl. No.: 14/947,514

(22) Filed: Nov. 20, 2015

(65) Prior Publication Data

US 2016/0144995 A1 May 26, 2016

(30) Foreign Application Priority Data

Nov. 20, 2014 (KR) ..... 10-2014-0162415
Feb. 27, 2015 (KR) ..... 10-2015-0028299

(51) Int. Cl.

| | |
|---|---|
| ***B65D 5/02*** | (2006.01) |
| ***B65D 85/68*** | (2006.01) |
| ***B65D 5/32*** | (2006.01) |
| ***B65D 5/42*** | (2006.01) |
| ***B65D 65/40*** | (2006.01) |

(Continued)

(52) U.S. Cl.

CPC ..... *B65D 5/0209* (2013.01); *B65D 5/32* (2013.01); *B65D 5/321* (2013.01); *B65D 5/326* (2013.01); *B65D 5/42* (2013.01); *B65D 5/4283* (2013.01); *B65D 65/403* (2013.01); *B65D 81/058* (2013.01); *B65D 81/107* (2013.01); *B65D 85/68* (2013.01); *B65D 2585/6837* (2013.01)

(58) Field of Classification Search

CPC ..... B65D 5/02; B65D 5/0209; B65D 5/32; B65D 5/321; B65D 5/326; B65D 5/42; B65D 5/4283; B65D 65/403; B65D 65/38; B65D 65/40

USPC ..... 206/521, 448, 454; 220/669, 623; 3/521, 3/448, 454

See application file for complete search history.

(56) References Cited

U.S. PATENT DOCUMENTS 2,382,368 A 8/1945 Mitchell, Jr.
2,867,369 A 1/1959 Cernera
(Continued)

FOREIGN PATENT DOCUMENTS

CN 1148360 A 4/1997
CN 1349920 A 5/2002
(Continued)

OTHER PUBLICATIONS

Communication dated Feb. 27, 2017 by the European Patent Office in counterpart European Patent Application No. 15195664.6.
(Continued)

*Primary Examiner* — Steven A. Reynolds
*Assistant Examiner* — Javier A Pagan
(74) *Attorney, Agent, or Firm* — Sughrue Mion, PLLC

(57) ABSTRACT

A packaging box is formed of corrugated cardboard, wherein end portions of the packaging box are protruded relative to a middle portion of the packaging box so that the packaging box has a curved shape, and a corrugation direction of the corrugated cardboard is parallel to a longitudinal direction of the packaging box.

24 Claims, 21 Drawing Sheets

(51) Int. Cl.
*B65D 81/107* (2006.01)
*B65D 81/05* (2006.01)

(56) References Cited

U.S. PATENT DOCUMENTS

| | | | | |
|---|---|---|---|---|
| 2,984,343 | A * | 5/1961 | Van Antwerpen | B65D 5/029 206/448 |
| 3,474,950 | A * | 10/1969 | Wharton, Jr. | B65D 85/20 206/443 |
| 2004/0232025 | A1 * | 11/2004 | Lunde | B44D 3/00 206/449 |
| 2012/0074823 | A1 * | 3/2012 | Bezich | A47B 87/0292 312/240 |
| 2012/0211396 | A1 | 8/2012 | Asanuma | |
| 2013/0308255 | A1 | 11/2013 | Sasaki et al. | |

FOREIGN PATENT DOCUMENTS

| | | | |
|---|---|---|---|
| CN | 2897883 | Y | 5/2007 |
| CN | 102849354 | A | 1/2013 |
| CN | 203473598 | U | 3/2014 |
| CN | 203793966 | U | 8/2014 |
| WO | 01/87720 | A1 | 11/2001 |
| WO | 2013/141769 | A1 | 9/2013 |

OTHER PUBLICATIONS

Communication dated Mar. 14, 2016, issued by the European Patent Office in counterpart European Patent Application No. 15195664.6.
Communication dated Sep. 1, 2016, issued by the European Patent Office in counterpart European Patent Application No. 15195664.6.
Communication dated Sep. 3, 2018, issued by the State Intellectual Property Office of P.R. China in counterpart Chinese Application No. 201510810932.7.
Communication dated Aug. 31, 2017, issued by the European Patent Office in counterpart European Application No. 15 195 664.6.

* cited by examiner

CORRUGATED PACKAGING BOX

CROSS-REFERENCE TO RELATED APPLICATION

This application claims priority from Korean Patent Application No. 10-2014-0162415, filed on Nov. 20, 2014, and the Korean Patent Application No. 10-2015-0028299, filed on Feb. 27, 2015, in the Korean Intellectual Property Office, the disclosures of which are incorporated herein by reference.

BACKGROUND

1. Field

Exemplary embodiments of the present disclosure relate to a packaging box for packaging an electronic product, and more particularly, a corrugated packaging box having a curved surface implemented thereof.

2. Description of the Related Art

In general, packaging boxes are in high demand and widely used. Some packaging boxes are manufactured from common paper, that is, pulp, since manufacturing costs often need to be low and handling and care often need to be easy.

However, when common paper, that is, the pulp, is used to manufacture packaging boxes, the common paper may need to be manufactured with at least a certain thickness for the sake of durability and impact resistance. As such, the weight of the packaging boxes may be increased.

To reduce the weight of the packaging boxes, however, packaging boxes may be manufactured using corrugated cardboard.

Corrugated packaging boxes are generally easy to manufacture, and the logistics cost (e.g., shipment and storage costs) may be reduced as corrugated packaging boxes may be assembled for use after being stored in an unfolded and stacked state. In addition, corrugated packaging boxes may be capable of storing a package safely while providing insulation capability and durability.

In some instances, corrugated packaging boxes intended to package a large electronic product such as a refrigerator, a washing machine, an air conditioner, a large-size TV, or a network server may be manufactured in the shape of a rectangular box or a cube, which may not reflect the shape of the product.

As such, when packaging a product having a curved surface into a rectangular box, a packaging space that is not necessary may be generated.

This extra packaging space of the packaging box may lead to difficulties such as damage to the product in the transporting process of the product.

SUMMARY

One or more exemplary embodiments provide a corrugated packaging box having a curved surface.

One or more exemplary embodiments also provide a corrugated packaging box formed of a corrugated cardboard having a corrugation direction corresponding to a horizontal direction of the corrugated packaging box.

One or more exemplary embodiments also provide a corrugated packaging box configured to communicate to a consumer, by use of the corrugated packaging box having a curved exterior appearance corresponding to a curved surface of a product, that the shape of the product is provided with a curved surface.

One or more exemplary embodiments also provide a corrugated packaging box capable of protecting a product having a curved surface when flaps, that is, upper panels and lower panels, of the corrugated packaging box, are closed.

One or more exemplary embodiments also provide a corrugated packaging box having the curved shape configured to be provided with a desired particular curvature.

In accordance with an aspect of exemplary embodiment, there is provided a packaging box formed of corrugated cardboard, wherein end portions of the packaging box are protruded relative to a middle portion of the packaging box so that the packaging box has a curved shape, and a corrugation direction of the corrugated cardboard is parallel to a longitudinal direction of the packaging box.

The packaging box may include at least one incision unit configured to prevent damage to a boundary of a portion of the packaging box when the packaging box is formed into the curved shape.

The at least one incision unit may be formed in the corrugation direction of the corrugated cardboard.

The packaging box may further include a plurality of panel units configured to be connected to one another, wherein the plurality of panel units includes: side panel units forming side panels of the packaging box; an upper panel unit formed at one side of the side panel unit so as to form an upper panel of the packaging box; a lower panel unit formed at the other side of the side panel unit so as to form a lower panel of the packaging box; and a connection unit formed on at least one of the side panel units and configured to be connected to another one of the side panel units.

The at least on incision unit may include a plurality of incision units provided between the side panel unit and the upper panel unit, and between the side panel unit and the lower panel unit.

The at least one incision unit may include a first incision unit formed in the corrugation direction of the corrugated cardboard, and second incision units formed extendedly and inclinedly from both end portions of the first incision unit.

Each of the upper panel unit and the lower panel unit may be divided into a plurality of panels.

The packaging box may further include a variation unit configured to vary a distance between the plurality of panels of the upper panel unit and a distance in between the plurality of panels of the lower panel unit when a curvature of the corrugated cardboard is deformed.

The variation unit may be configured to vary an angle between two adjacent panels of the plurality of panels of the upper panel unit.

The variation unit may be configured to vary an angle between two adjacent panels of the plurality of panels of the lower panel unit.

The packaging box may further include a first box configured to form an upper portion of the packaging box, and a second box detachably provided at a lower side of the first box, and a fixation unit configured to connect the first box and the second box.

The fixation unit may include: a first fixation hole formed in the first box, a second fixation hole formed in the second box, and a fixing member configured to penetrate the first fixation hole and the second fixation hole.

The packaging box may further include a cushion member configured to be disposed within the second box, wherein the cushion member has a curved shape, and the second box includes an assembly unit configured to connect the second box with the cushion member.

The plurality of panels of the upper panel unit and the plurality of panels of the lower panel unit may be configured to overlap one another when the curvature of the packaging box is deformed.

Each of the upper panel unit and the lower panel unit may include a creasing line and a cutting line that are configured to meet each other when foldedly deformed while having the creasing line as a center.

According to an aspect of another exemplary embodiment, there is provided a packaging box including a plurality of panel units formed of corrugated cardboard including a pair of cardboards and a corrugating medium providing corrugation in between the pair of cardboards, wherein the plurality of panel units are connected to each other and configured to be assembled by folding, a part of the plurality of panel units is deformed into a curved shape in which both end portions of the packaging box are protruded relative to a middle portion of the packaging box, and a corrugation direction of the corrugated medium is parallel to a longitudinal direction of the packaging box.

The packaging box may further include at least one incision unit formed in the corrugation direction of the corrugated cardboard.

The plurality of panel units of the corrugated cardboard may include: a side panel unit having a plurality of side panels configured to form side panels of the packaging box; an upper panel unit including a plurality of panels dividedly configured to form an upper panel of the packaging box; a lower panel unit including a plurality of panels dividedly configured to form a lower panel of the packaging box; and a connection unit formed on at least one of the side panels and configured to be connected to another one of the side panels.

The at least one incision unit may include a first incision unit formed in the corrugation direction of the corrugated cardboard, and second incision units formed extendedly and inclinedly from both end portions of the first incision unit.

The at least one incision unit may include a plurality of incision units provided between the side panel unit and the upper panel unit and between the side panel unit and the lower panel unit.

The packaging box may further include a variation unit configured to, when a curvature of the corrugated cardboard is deformed, vary a distance in between the plurality of panels of the upper panel unit and a distance in between the plurality of panels of the lower panel unit.

The variation unit may include a first variation unit configured to vary an angle in between two adjacent panels of the plurality of panels of the upper panel unit.

The variation unit may include a second variation unit configured to vary an angle in between two adjacent panels of the plurality of panels of the lower panel unit.

The packaging box may further include a first box configured to form an upper portion of the packaging box, a second box detachably provided at a lower side of the first box, and a fixation unit configured to detachably connect the first box to the second box.

The fixation unit may include a first fixation hole formed in the first box, a second fixation hole formed in the second box, and a fixing member configured to penetrate the first fixation hole and the second fixation hole.

The plurality of upper panels and the plurality of lower panels may be configured to overlap one another when a curved surface of the packaging box is deformed.

Each of the plurality of upper panels and the plurality of lower panels may include a creasing line and a cutting line that are configured to meet each other when foldedly deformed while having the creasing line as a center.

BRIEF DESCRIPTION OF THE DRAWINGS

The above and/or other aspects will become apparent and more readily appreciated from the following description of exemplary embodiments, taken in conjunction with the accompanying drawings of which.

DETAILED DESCRIPTION

Figure 1:
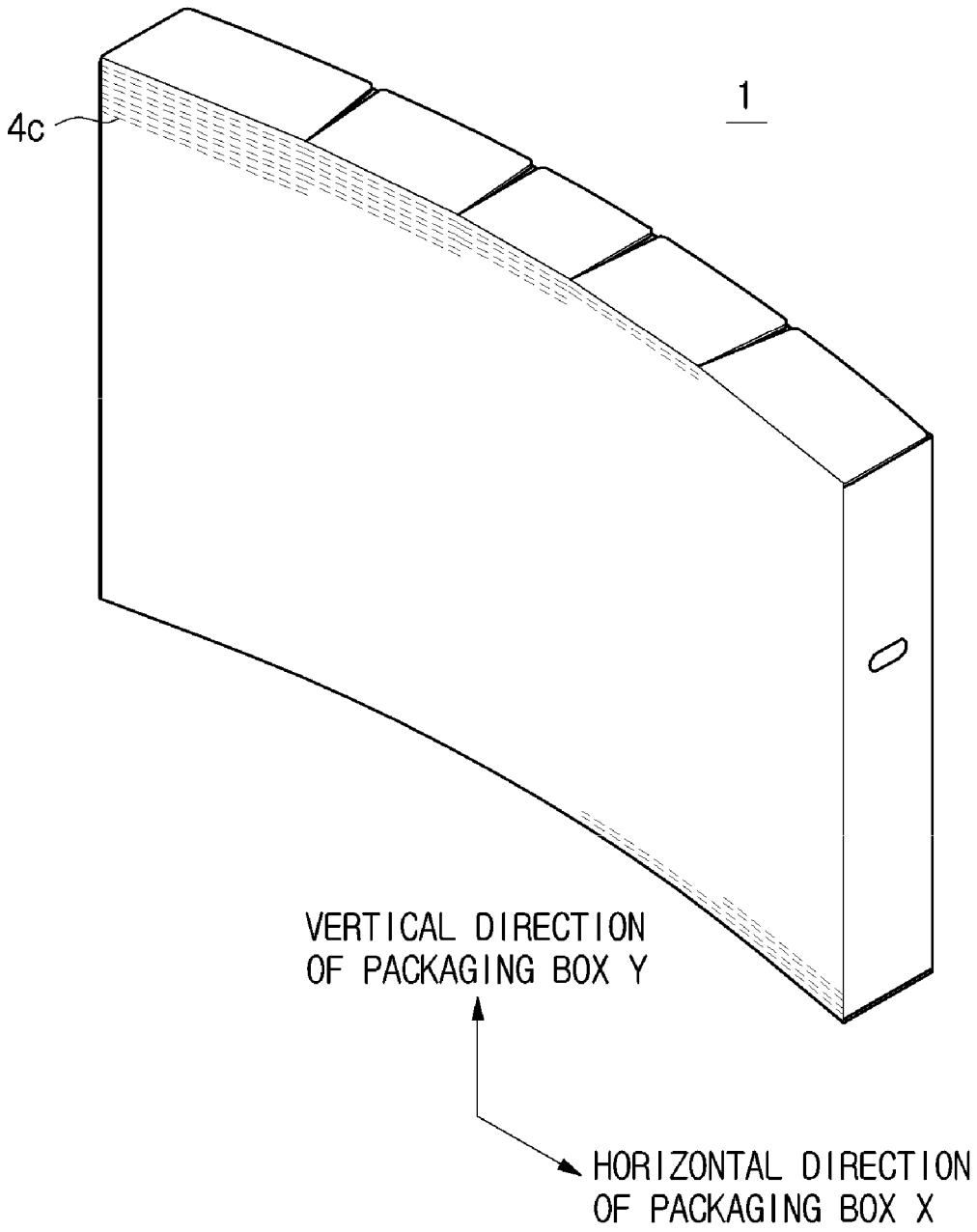
FIG. 1 is a perspective view showing a corrugated packaging box according to an exemplary embodiment.

Reference will now be made in detail to the exemplary embodiments of with reference to the accompanying drawings, wherein like reference numerals refer to like elements throughout. The terminologies used hereinafter, such as "front end," "rear end," upper portion," "lower portion," "upper end," and "lower end," are defined by referring to the drawings, and the shape and position of each component is not limited by the terminologies as such.

The present disclosure may be applicable to all packaging boxes configured to package a product by means of storing as to transport or display.

FIGS. 1-7 are drawings illustrating a corrugated packaging box according to an exemplary embodiment.

Figure 2:
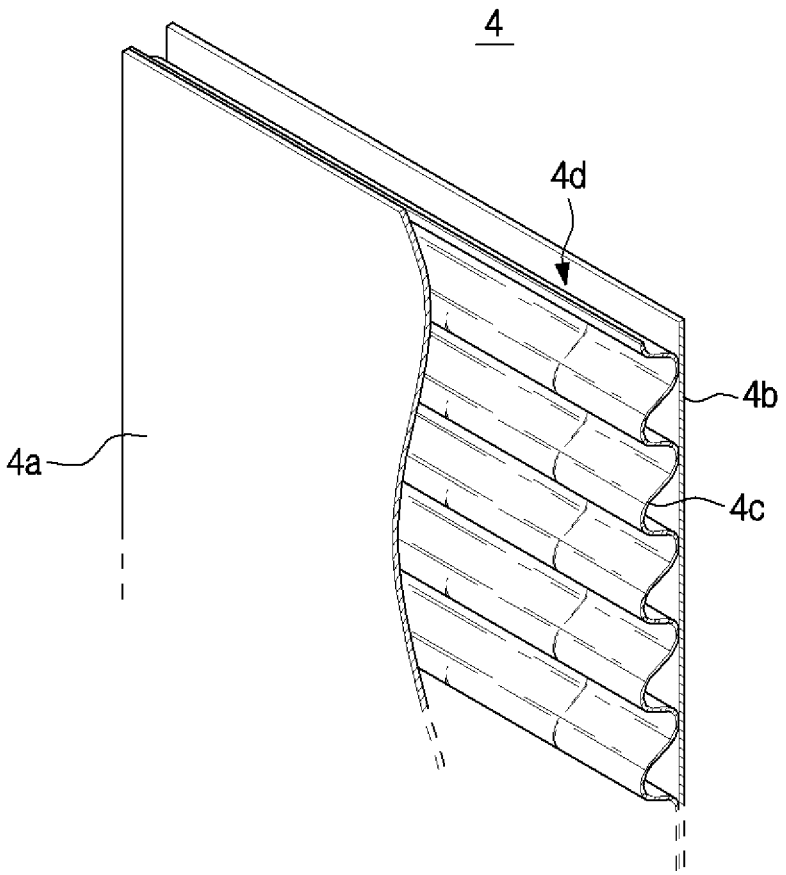
FIG. 2 is a drawing schematically showing a corrugated cardboard according to an exemplary embodiment.
Figure 3:
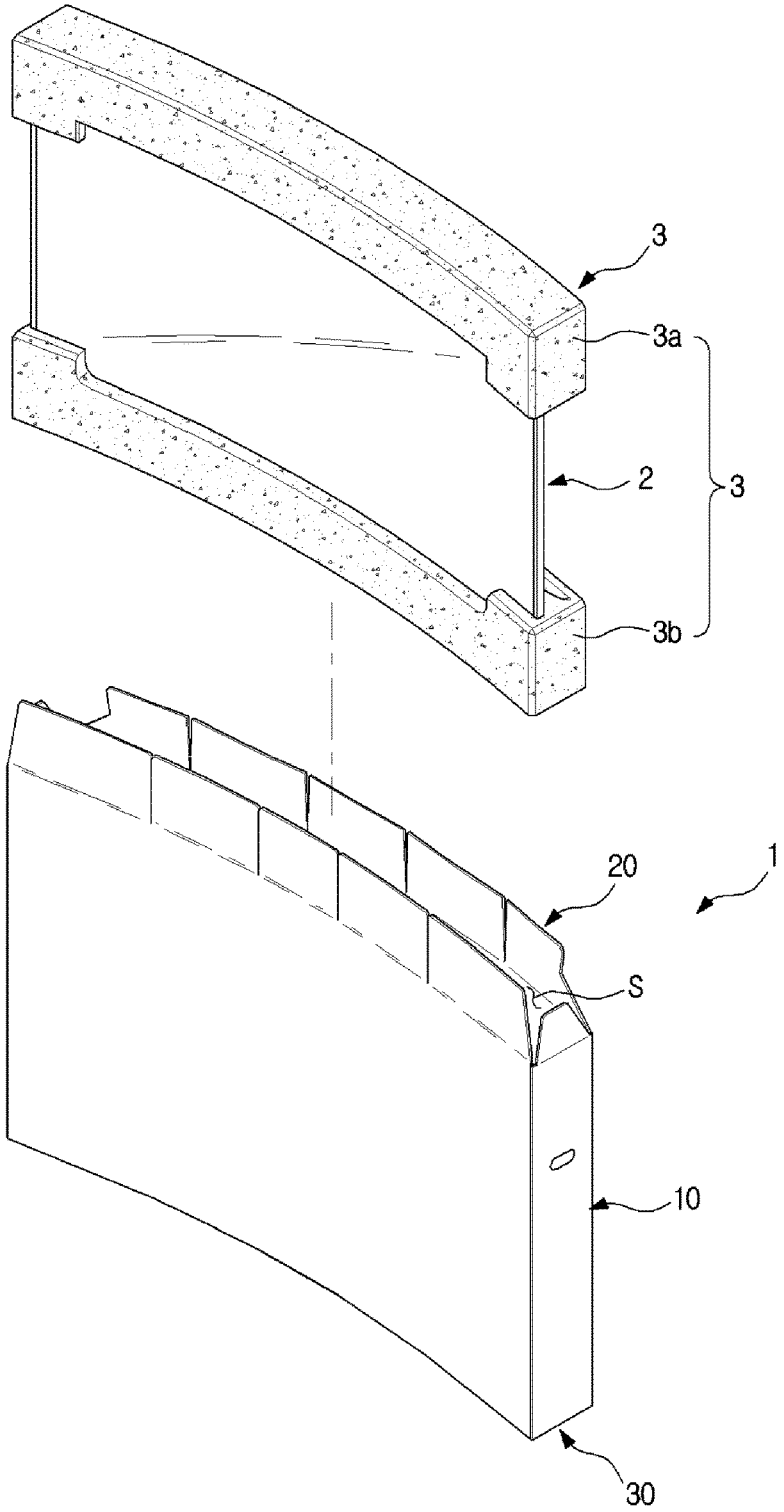
FIG. 3 is a drawing showing a display apparatus having the shape of a curved surface being packaged in a corrugated packaging box according to an exemplary embodiment.

As illustrated in FIGS. 1-3, a corrugated packaging box 1 is provided such that a product having a curve-shaped surface, such as a display apparatus, a toy, a computer, or other smart apparatus having the curve-shaped surface, may be accommodated therein. Hereinafter, the corrugated packaging box 1 provided to package a display apparatus 2 will be used as an example for descriptions.

The corrugated packaging box 1 may be formed such that the display apparatus 2 having the curve shaped surface may be accommodated therein.

Among other materials, the corrugated packaging box 1 may be formed of corrugated cardboard 4.

The corrugated cardboard 4 includes a corrugating medium 4*d* provided such that a corrugation 4*c* is formed, and a pair of cardboards 4*a* and 4*b* are provided to be attached to both surfaces of the corrugating medium 4*d*.

The pair of cardboards 4*a* and 4*b* includes a first cardboard 4*a* adhesively attached to one surface of the corrugating medium 4*d*, and a second cardboard 4*b* adhesively attached to the other surface of the corrugating medium 4*d*.

In addition, a coating layer may be applied to outer surfaces of the first cardboard 4*a* and the second cardboard 4*b* in certain cases.

In some embodiments, the thickness of the corrugated cardboard 4 is at least about 0.3 mm.

In addition, the corrugated cardboard 4 is manufactured such that a direction of corrugations 4*c* of the corrugating medium 4*d* provided in between the pair of cardboards 4*a* and 4*b*, corresponds to a horizontal or longitudinal direction X of the corrugated packaging box 1.

In addition, the corrugated cardboard 4 includes a plurality of panel units formed in the shape of a plane.

The plurality of panel units of the corrugated packaging box 1 is configured to be folded by use of a plurality of creasing lines 50. In some embodiments, the direction of the corrugation 4*c* may be provided in an identical direction with respect to the horizontal direction X of the corrugated packaging box 1.

The corrugated packaging box 1 may include an upper panel unit 20 forming an upper panel, a lower panel unit 30 forming a lower panel, and a side panel unit 10 forming side panels.

An accommodation space S may be provide within the corrugated packaging box 1. The accommodation space S is formed by the lower panel unit 30 and the side panel unit 10. The accommodation space S has a size and shape which corresponds to the size and shape of the display apparatus 2, having the curve-shaped surface, such that the display apparatus may be accommodated therein.

The display apparatus 2, having the curve shaped surface, is supported by use of a cushion member 3 provided at each of an upper end and a lower end of the display apparatus 2, and is provided at the accommodation space S of the corrugated packaging box 1.

The corrugated packaging box 1 is formed in a curved shape, as both end portions of the corrugated packaging box 1 are protruded relative to a middle portion of the corrugated cardboard 4.

The plurality of panel units (the upper panel unit 20, the side panel unit 10, and the lower panel unit 30) of the corrugated cardboard 4 is folded by use of the creasing lines 50 to thereby form the corrugated packaging box 1 having the curved shape.

Figure 4:
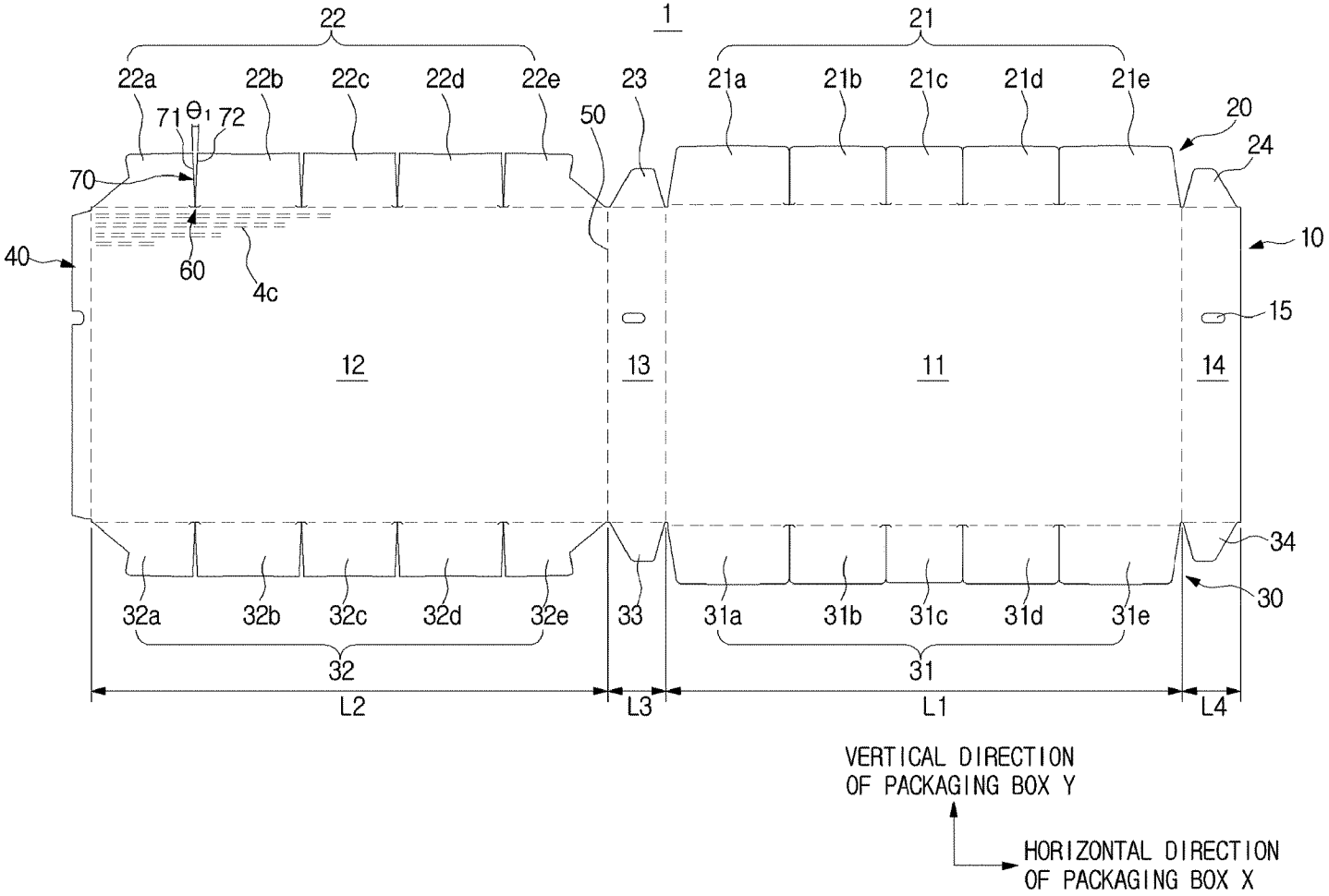
FIG. 4 is a development view of a corrugated packaging box according to an exemplary embodiment.
Figure 5:
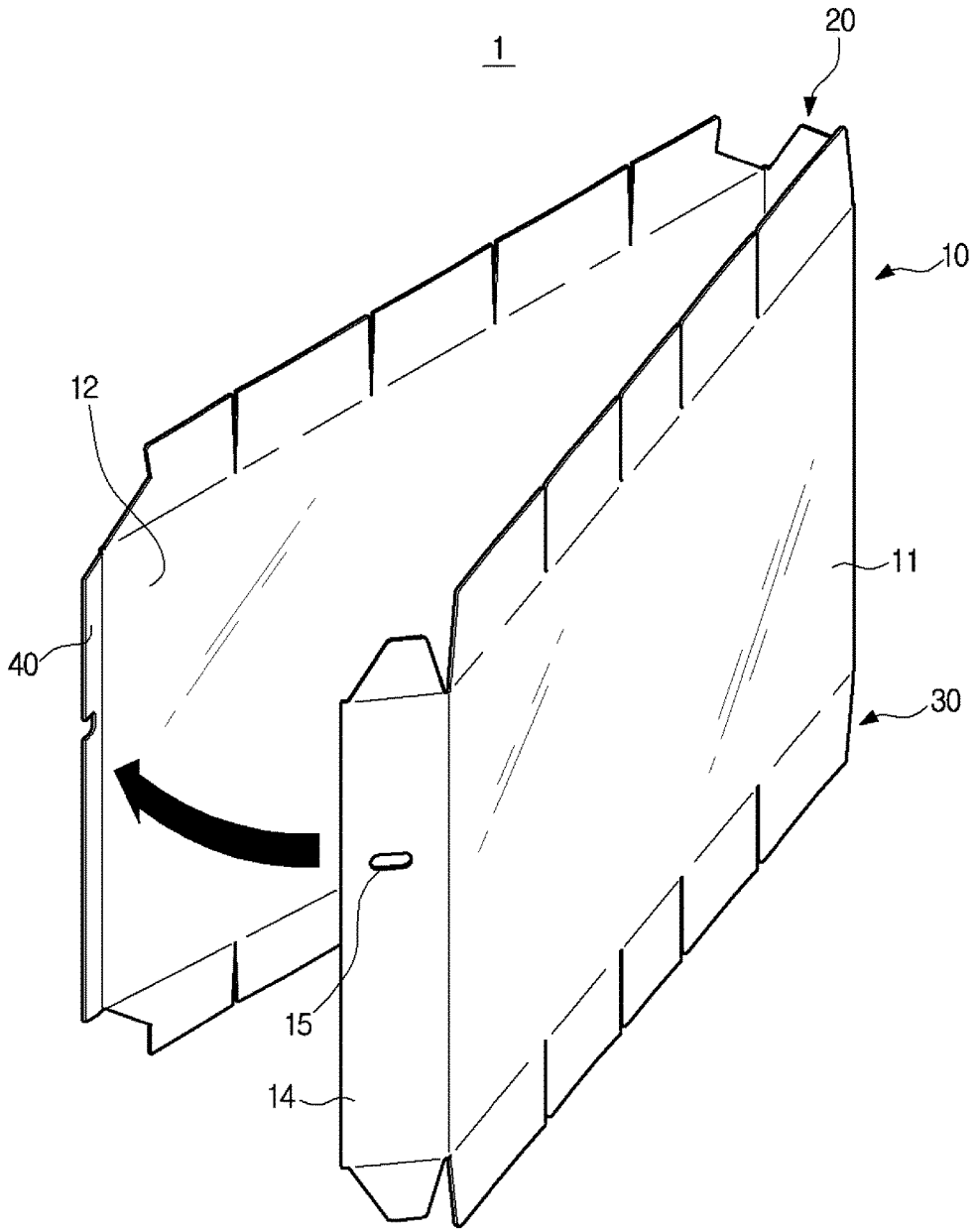
FIG. 5 is a drawing showing a movement of a connection unit of a corrugated packaging box according to an exemplary embodiment.
Figure 6:
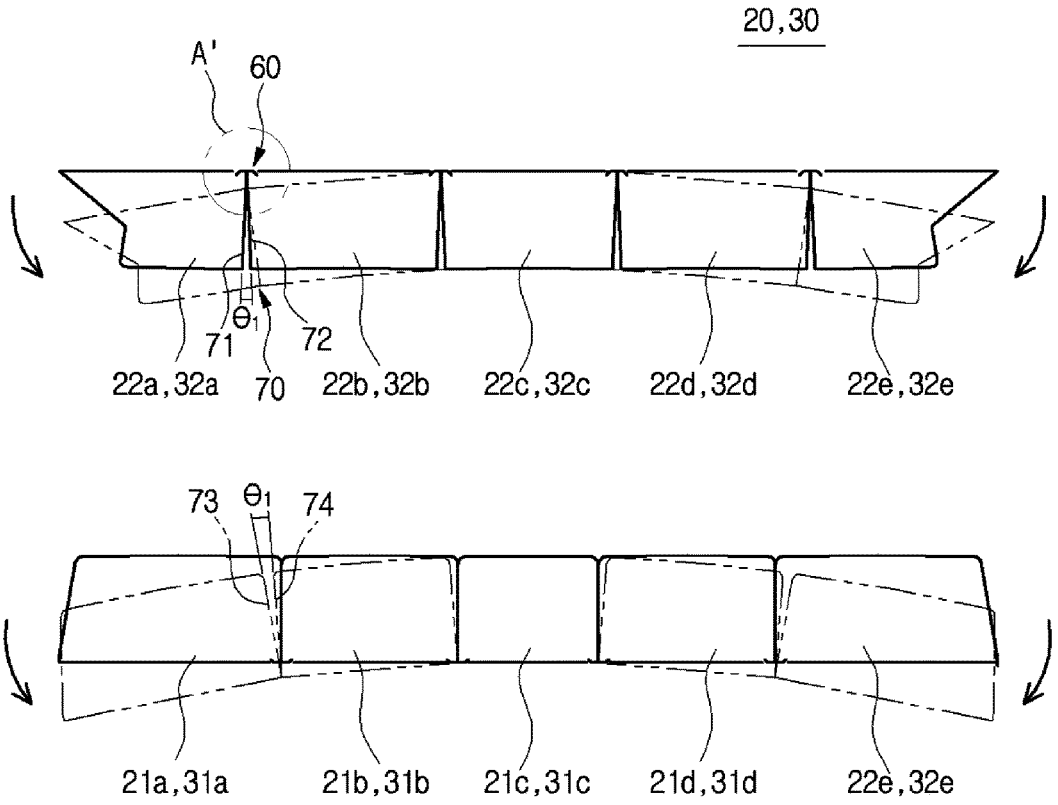
FIG. 6 is a drawing showing a movement of an upper panel unit at a time when a curvature state of a corrugated packaging box is deformed according to an exemplary embodiment.
Figure 7:
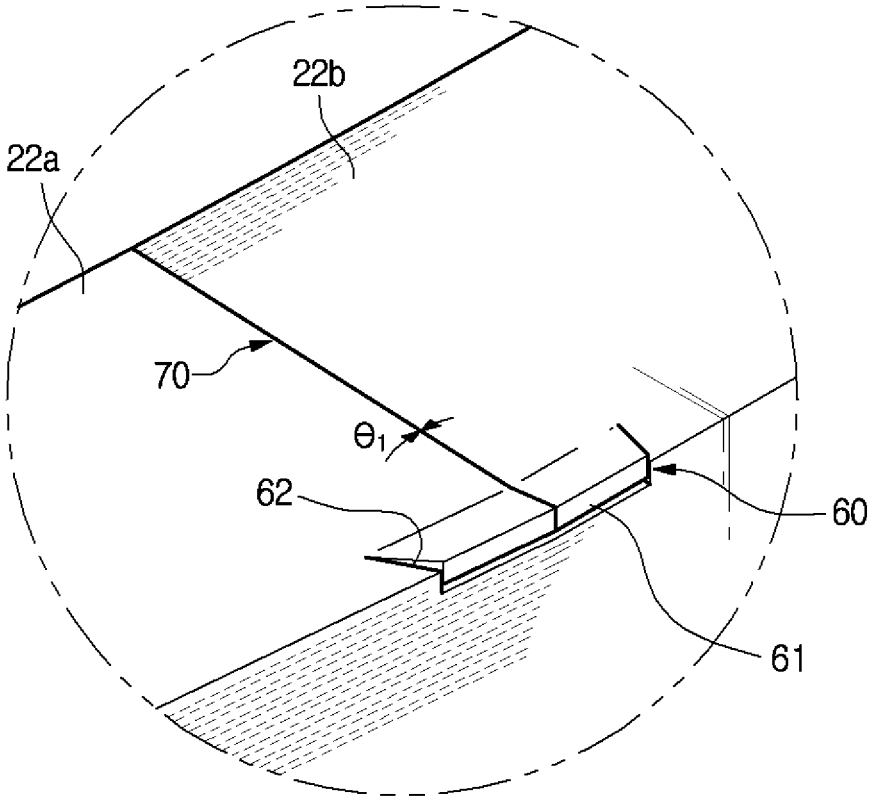
FIG. 7 is an expanded view of portion A' of FIG. 6.

FIG. 4 is a development view of the corrugated packaging box according to an exemplary embodiment. FIG. 5 is a drawing showing movement of a connection unit of the corrugated packaging box 1 according to an exemplary embodiment. FIG. 6 is a drawing showing movement of the panel units 20, 30 at a time when the curvature state of the corrugated packaging box 1 is deformed according to an exemplary embodiment. FIG. 7 is an expanded view of portion A' of FIG. 6.

As illustrated in FIGS. 4-7, the side panel unit 10 of the corrugated packaging box 1 includes a first side panel 11, a second side panel 12 configured to face the first side panel 11, a third panel 13 disposed between the first side panel 11 and the second side panel 12, and a fourth side panel 14 configured to face the third side panel 13.

The first side panel 11 is configured to form a front panel of the corrugated packaging box 1. The second side panel 12 is configured to form a rear panel while disposed and spaced apart by a predetermined distance at a rear of the first side panel 11.

In the present embodiment, the horizontal length L1 of the first side panel 11 is identical to the length of the horizontal length L2 of the second side panel 12. The horizontal length L3 of the third side panel 13 is identical to horizontal length L4 of the fourth side panel 14.

Although in the present embodiment, the horizontal lengths of the first side panel 11 and the second side panel 12 forming the front panel and the rear panel of the corrugated packaging box 1 are illustrated to be identical, in other embodiments, the horizontal lengths of the first side panel 11 and the second side panel 12 may be different from one another. For example, the horizontal length of the first side panel 11 may be shorter than the horizontal length of the second side panel 12.

The side panel unit 10 may be provided with a handle hole 15 formed therein so as to provide convenience to a user during moving or transporting of the corrugated packaging box 1.

The handle hole 15 may be formed in each of the third side panel 13 and the fourth side panel 14, so that a user may easily carry the corrugated packaging box 1 while holding the handle holes 15 formed in the sides of the third side panel 13 and the fourth side panel 14.

In addition, a connection unit 40 configured to connect to the fourth side panel 14 is provided at the second side panel 12 of the side panel unit 10.

The connection unit 40 is extends from one side of the second side panel 12, and may be provided to make contact with an inner side of the fourth side panel 14 by use of the creasing lines 50.

In some embodiments, the connection unit 40 is provided with an adhesive applied to an outer side surface thereof, and is configured to connect the second side panel 12 and the fourth side panel 14 when the connection unit 40 makes contact with an inner side of the fourth side panel 14.

The connection unit 40 in the present embodiment is illustrated as extending from the second side panel 12, but may extend from any other appropriate portion of the corrugated packaging box 1. For example, the connection unit 40 may be disposed between the second side panel 12 and the third side panel 13, the third side panel 13 and the first side panel 11, or the first side panel 11 and the fourth side panel 14.

An upper side and a lower side of the side panel unit 10 are provided with the upper panel unit 20 and the lower panel unit 30 connectively formed thereto, respectively. The creasing line 50 is provided in between the side panel unit 10 and the upper panel unit 20 and in between the side panel unit 10 and the lower panel unit 30 such that the corrugated cardboard 4 may be folded.

The upper panel unit 20, disposed at an upper side of the side panel unit 10, includes a first upper panel 21 formed at an upper side of the first side panel 11, a second upper panel 22 formed at an upper side of the second side panel 12, a third upper panel 23 formed at an upper side of the third side panel 13, and a fourth upper panel 24 formed at an upper side of the fourth side panel 14.

The first upper panel 21 and the second upper panel 22, formed at the upper sides of the first side panel 11 and the second side panel 12 respectively, are divided so as to form a plurality of units or panels.

The lower panel unit 30 disposed at a lower side of the side panel unit 10, includes a first lower panel 31 formed at a lower side of the first side panel 11, a second lower panel 32 formed at a lower side of the second side panel 12, a third lower panel 33 formed at a lower side of the third side panel 13, and a fourth lower panel 34 formed at a lower side of the fourth side panel 14.

The first lower panel 31 and the second lower panel 32, formed at the lower sides of the first side panel 11 and the second side panel 12 respectively, are also divided so as to form a plurality of units or panels.

Panel units 21, 22, 31, 32 are divided so that creasing of the upper panel unit 20 and the lower panel unit 30 may be prevented when deforming the corrugated cardboard 4 into the state of a curved surface by moving both end portions of the first side panel 11 and the second side panel 12 toward the middle portion of the corrugated cardboard 4.

In the present embodiment, in between the side panel unit 10 and the upper panel unit 20, as well as in between the side panel unit 10 and the lower panel unit 30, an incision unit 60 is provided to be formed such that damage, such as creasing or bursting, does not occur at the corrugated cardboard 4 when the corrugated cardboard 4 is deformed in the curved shape.

The incision unit 60 may be disposed along the creasing line 50 formed in between the side panel unit 10 and the upper panel unit 20, as well as in between the side panel unit 10 and the lower panel unit 30.

The incision unit 60 may be disposed at a connecting portion of a plurality of upper panels 21*a*, 21*b*, 21*c*, 21*d*, and 21*e* of the first upper panel 21 and a plurality of upper panels 22*a*, 22*b*, 22*c*, 22*d*, and 22*e*, of the second upper panel 22 respectively, as the plurality of upper panels 21*a*, 21*b*, 21*c*, 21*d*, and 21*e* and the plurality of upper panels 22*a*, 22*b*, 22*c*, 22*d*, and 22*e* are provided to form the upper panel unit 20. That is, the incision unit 60 may be formed in between a certain one of the upper panels, for example, the upper panel 21*a* of the first upper panel 21, and another upper panel, for example, the upper panel 21*b*, which is adjacent to the upper panel 21*a*. The incision unit 60 may also be disposed at a connecting portion of a plurality of lower panels 31*a*, 31*b*, 31*c*, 31*d*, and 31*e* of the first lower panel 31 and a plurality of lower panels 32*a*, 32*b*, 32*c*, 32*d*, and 32*e*, of the second lower panel 32 respectively, as the plurality of lower panels 31*a*, 31*b*, 31*c*, 31*d*, and 31*e* and the plurality of lower panels 32*a*, 32*b*, 32*c*, 32*d*, and 32*e* are provided to form the lower panel unit 30. That is, the incision unit 60 may be formed in between a certain one of the lower panels, for example, the lower panel 31*a* of the first lower panel 31, and another lower panel, for example, the lower panel 31*b*, which is adjacent to the lower panel 31*a*.

In some embodiments, the incision unit 60 is disposed at the creasing line 50, which is in between the first side panel 11 and the in-between of the upper panel 21*a* and the adjacent upper panel 21*b* of the first upper panel 21.

As best seen in FIG. 7, the incision unit 60 includes a first incision unit 61 formed in the direction of the corrugation 4*c* of the corrugated cardboard 4, and a second incision unit 62 inclinedly and extendedly formed at both end portions of the first incision unit 61.

The second incision unit 62 is formed such that damage, such as bursting or creasing of the corrugated cardboard 4, does not occur when deforming the corrugated cardboard 4 in the curved shape. Although, the second incision unit 62 in the present embodiment is illustrated to be formed in a diagonal direction of the corrugated packaging box 1 toward an outer side direction of each first incision unit 61, but is not limited hereto. The second incision unit 62 may be formed in a vertical direction Y of the corrugated packaging box 1.

In addition, the upper panel unit 20 structured with the plurality of upper panels 21 and 22 includes a variation unit 70 provided to vary the distance in between the upper panels 21 and 22 when the corrugated cardboard 4 is deformed in the curved shape.

The variation unit 70 may be formed in between the plurality of upper panels 21 and 22. The variation unit 70 is formed in between one upper panel of the plurality of upper panels 21 and 22, and another upper panel of the plurality of upper panels 21 and 22 that is adjacent to the one upper panel.

For example, the variation unit 70 is formed in between a certain one upper panel, for example, the upper panel 22*a* of the second upper panel 22, and another upper panel, for example, the upper panel 22*b* of the second upper panel 22, which is adjacent to the upper panel 22*a*. A variation angle θ1, which is varied according to the deformation of the curvature, may be formed in between one side end 71 of the one upper panel 22*a* and another side end 72 corresponding to the another upper panel 22*b*. The variation angle θ1 in between the one upper panel 22*a* and another upper panel 22*b* is decreased when the curvature state of the corrugated packaging box 1 is deformed.

In addition, the variation unit 70 is formed in between a certain one upper panel, for example, the upper panel 21*a* of the first upper panel 21, and another upper panel, for example, the upper panel 21*b* of the first upper panel 21, which is adjacent to the upper panel 21*a*. The variation angle θ1 formed in between one side end 73 of the one upper panel 21*a* and another side end 74 corresponding to the another upper panel 21*b* is increased at the time when the curvature state of the corrugated packaging box 1 is deformed.

The variation angle θ1, of the variation unit 70 formed in between the plurality of upper panels 21*a*, 21*b*, 21*c*, 21*d*, and

21*e* of the first upper panel 21, is increased at the time when the curvature state of the corrugated packaging box 1 is deformed, and the variation angle θ1, of the variation unit 70 formed in between the plurality of upper panels 22*a*, 22*b*, 22*c*, 22*d*, and 22*e* of the second upper panel 22, is decreased at the time when the curvature state of the corrugated packaging box 1 is deformed (FIG. 6).

When deforming the curvature state of the corrugated packaging box 1, both end portions of the first side panel 11 forming the front panel are moved forward, and the upper panels 21*a*, 21*b*, 21*d*, and 21*e* are moved forward of the upper panel 21*c*, which is disposed at a middle of the upper panels. The front of the first upper panel 21 is fixed while connected to the first side panel 11, and thus the distance in between the respective upper panels 21*a*, 21*b*, 21*d*, and 21*e* is widened.

In addition, when deforming the curvature state of the corrugated packaging box 1, both end portions of the second side panel 12 forming the rear panel are moved forward, and the upper panels 22*a*, 22*b*, 22*d*, and 22*e* are moved forward of the upper panel 22*c*, which is disposed at a middle of the upper panels. The rear of the second upper panel 22 is fixed while connected to the second side panel 12, and thus the distance in between the respective upper panels 22*a*, 22*b*, 22*d*, and 22*e* is narrowed.

It should be appreciated that the lower panel 30 of the corrugated packaging box 1 may be identically applied as in the upper panel 20.

Therefore, the corrugated packaging box 1, using the corrugated cardboard 4, is provided to form a side panel by connecting the connection unit 40 formed at one of the side panels 20, to another one of the side panels 20, and the curved shape may be formed by use of the variation units 70 of the lower panel 30 and the upper panel 20.

The upper panel unit 20 may cover an upper portion of the corrugated packaging box 1 using the first panel 21, as well as the second upper panel 22 which overlaps the first upper panel 21 or vice versa. Similarly, the lower panel 30 may cover a lower portion of the corrugated packaging box 1 using the first lower panel 31, as well as the second lower panel 32 which overlaps the first lower panel 31 or vice versa. As such, the durability of the upper end panel and the lower end panel of the corrugated packaging box 1 may be enhanced.

In addition, by coinciding the horizontal direction X of the corrugated packaging box 1 and the direction of the corrugation 4*c* of the corrugated cardboard 4, the strength of the horizontal direction X of the corrugated packaging box 1 may be enhanced.

The enhancement of the strength of the corrugated packaging box 1 as described above, may enable the corrugated packaging box 1 to be stacked and transported.

Figure 8:
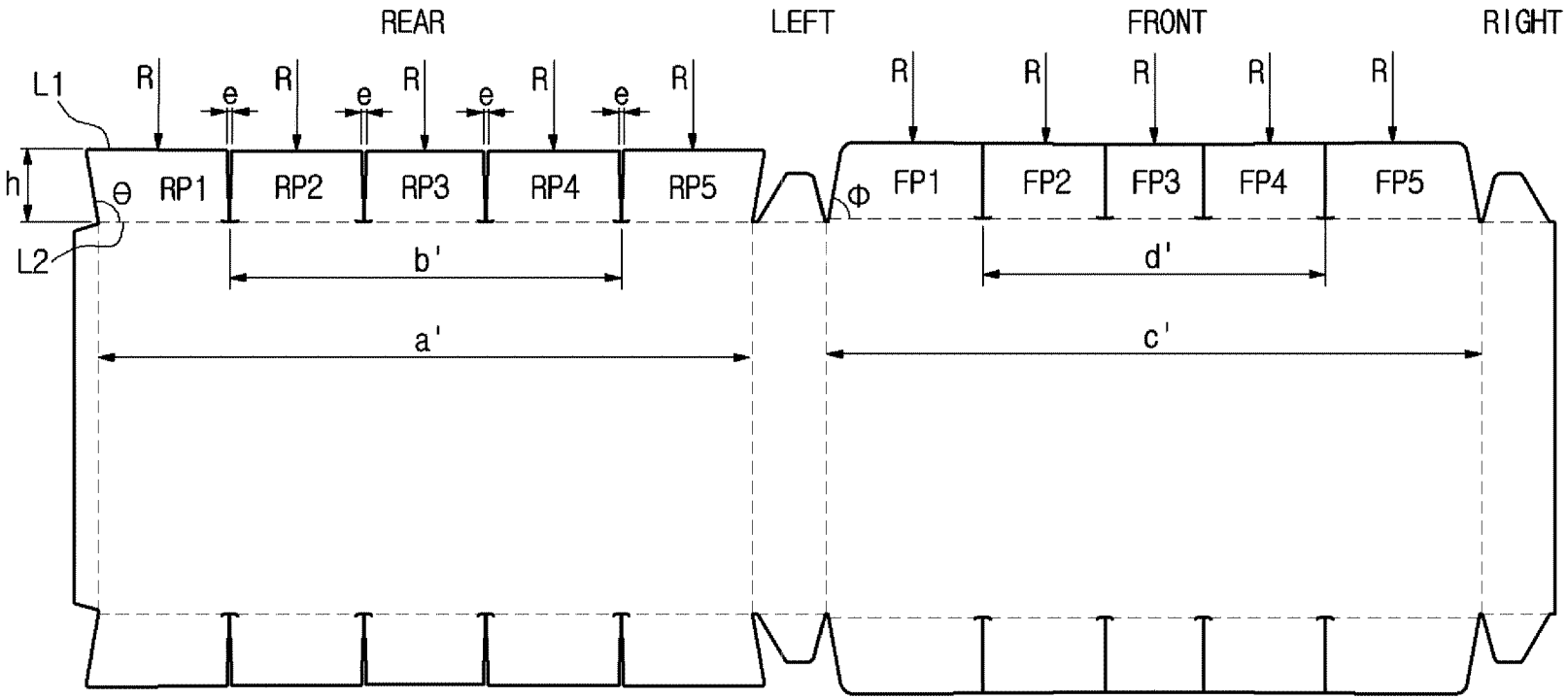
FIG. 8 is a development view of a corrugated packaging box having a particular curvature according to an exemplary embodiment.
Figure 9:
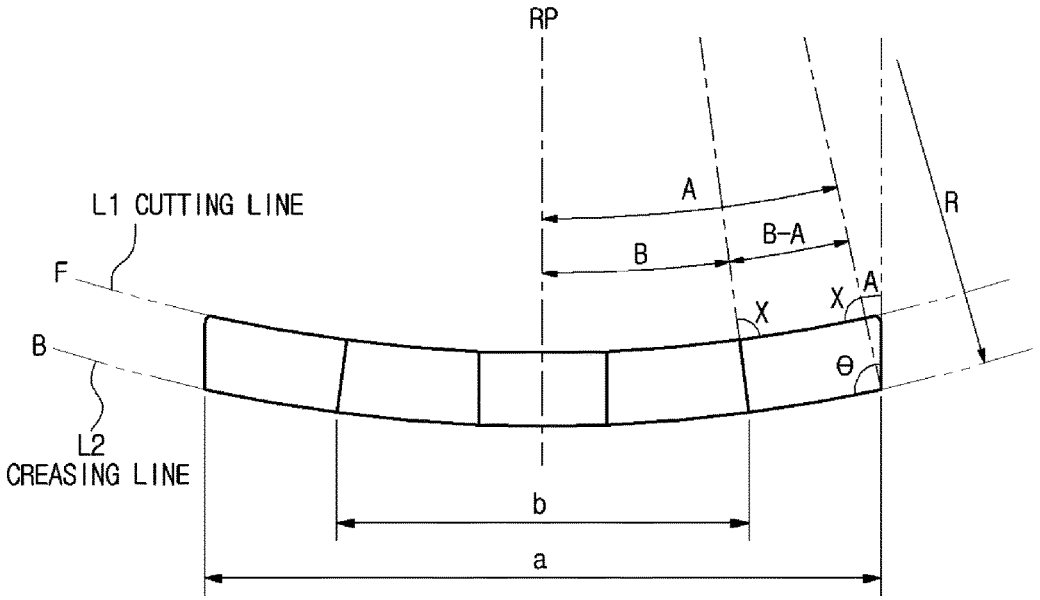
FIG. 9 is a development view showing a rear panel being disposed at a rear of a corrugated packaging box having a particular curvature according to an exemplary embodiment.
Figure 10:
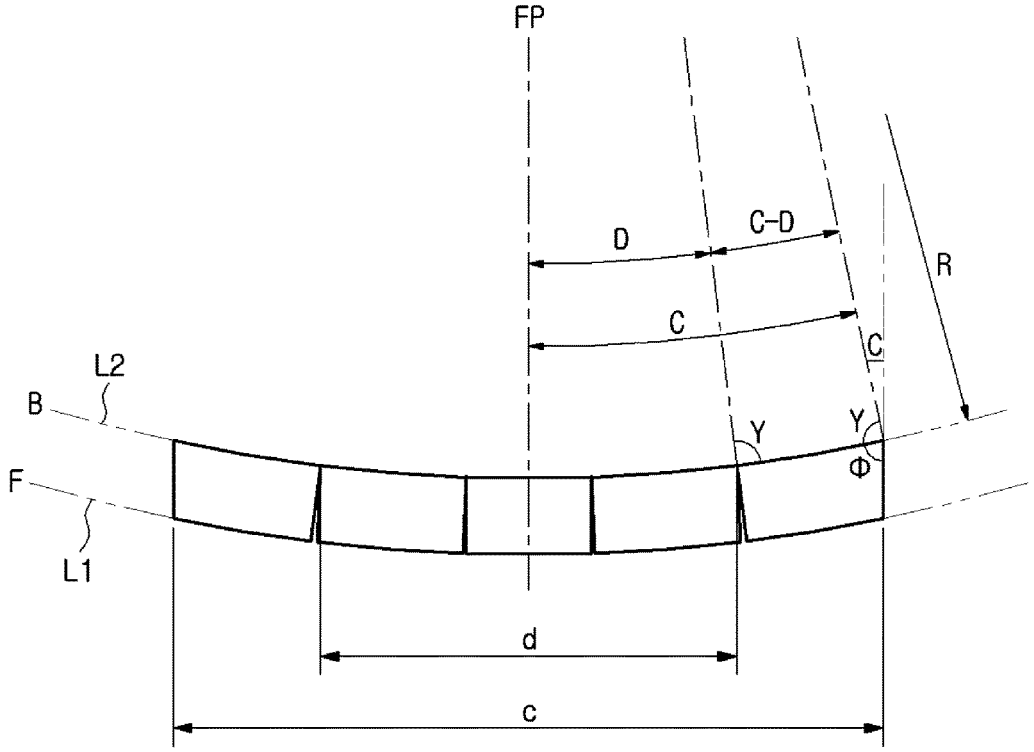
FIG. 10 is a development view showing a front panel being disposed at a front of a corrugated packaging box having a particular curvature according to an exemplary embodiment.

As illustrated from FIG. 8 to FIG. 10, the corrugated packaging box according to an exemplary embodiment may be designed using a formula to provide the corrugated packaging box with a particular curvature such that a front panel FP and a rear panel RP are overlapped when the divided upper panels are folded.

The corrugated packaging box 1 may include a front panel FP, which is divided, and a rear panel RP, which is also divided, corresponding to the front panel FP. The front panel FP of the present embodiment is divided into five units, and includes a first front panel FP1, a second front panel FP2, a third front panel FP3, a fourth front panel FP4, and a fifth front panel FP5, and the rear panel RP of the present embodiment is also divided into five units, and includes a first rear panel RP1, a second rear panel RP2, a third rear panel RP3, a fourth rear panel RP4, and a fifth rear panel RP5, but the aspect of the present disclosure is not limited hereto. For example, the division of the front panel FP and the rear panel RP may be changed according to the size of the corrugated packaging box.

The divided upper panel of the corrugated packaging box 1 may include a cutting line L1 and a creasing line L2.

The cutting line L1 and the creasing line L2 of the front panel FP and the rear panel RP may be disposed in opposite directions with respect to each other.

The width of the corrugated packaging box 1 is referred to as 'a' or 'c', the length of the rear panel of the rear panel RP is referred to as 'a'', the distance between flaps between the respective divided rear panels RP is referred to as 'b', the length of the flaps of the rear panel RP is referred to as 'b'', the length of the front panel FP is referred to as 'c'', and the length of flaps of the front panel FP is referred to as 'd''.

The angle of the rear panel RP is referred to as 'θ', which is an angle of the flaps of the rear panel RP, and the angle of the front panel FP is referred to as 'φ', which is an angle of the flaps of the front panel FP.

Assuming that the number of the divided front panel is referred to as 'n', which is the number of flaps, the height of the divided front panels is referred to as 'h', which is the height of the flap, and the distance between the front panel is referred to as 'e', which is the distance between the flaps, the above may be established as to satisfy the following Formula (1):

[Formula (1)]

$$A = \cos^{-1}\left(\frac{\sqrt{R^2 - \left(\frac{a}{2}\right)^2}}{R}\right),\ B = \cos^{-1}\left(\frac{\sqrt{R^2 - \left(\frac{b}{2}\right)^2}}{R}\right),$$

$$C = \cos^{-1}\left(\frac{\sqrt{R^2 - \left(\frac{c}{2}\right)^2}}{R}\right),\ D = \cos^{-1}\left(\frac{\sqrt{R^2 - \left(\frac{d}{2}\right)^2}}{R}\right)$$

$$\Theta = (X + A) = \left[\frac{\pi - (A - B)}{2} + A\right] = \frac{\pi + (A + B)}{2}$$

$$\Phi = \pi - (Y + C) = \pi - \left[\frac{\pi - (C - D)}{2} + C\right] = \frac{\pi - (C - D)}{2}$$

$$a' = r \times 2A$$

$$b' = b \times 2B$$

$$c' = c \times 2C$$

$$d' = d \times 2D$$

$$e = h \times \frac{\tan\left(\Theta - \frac{\pi}{2}\right)}{n - 1}$$

And, the divided front panel FP and the rear panel RP having the curvature formed by use of the figures that satisfy the above-described formula (1) may form a curved surface formed by use of the particular curvature, and at the same time, the front panel FP and the rear panel RP are completely overlapped.

As such, the corrugated packaging box 1 is formed such that the front panel FP and the rear panel RP are covered by one another while completely overlapping each other, thus making forming of the curved shape easier, and enhancing durability.

Figure 11:
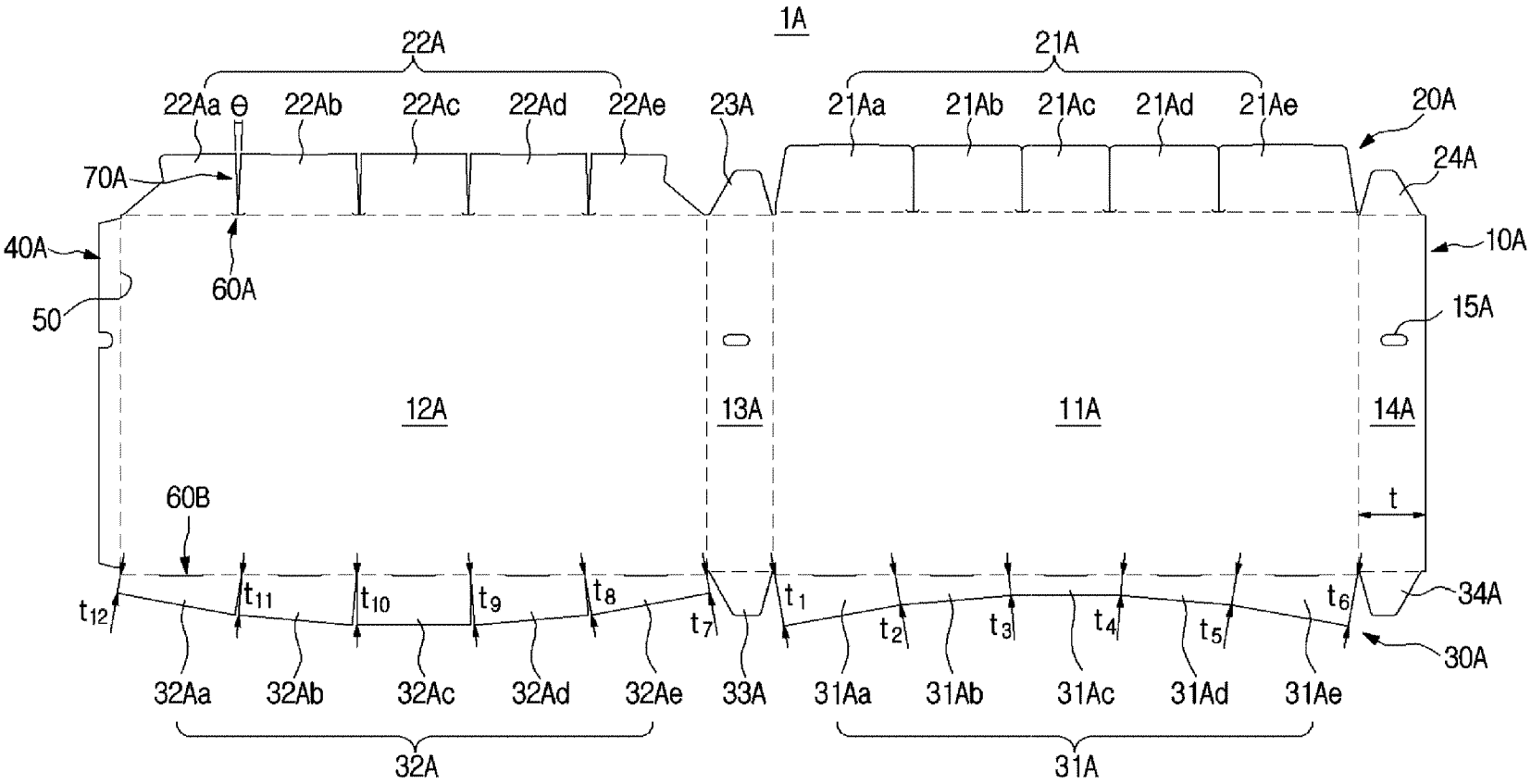
FIG. 11 is a development view of a corrugated packaging box according to an exemplary embodiment.
Figure 12:
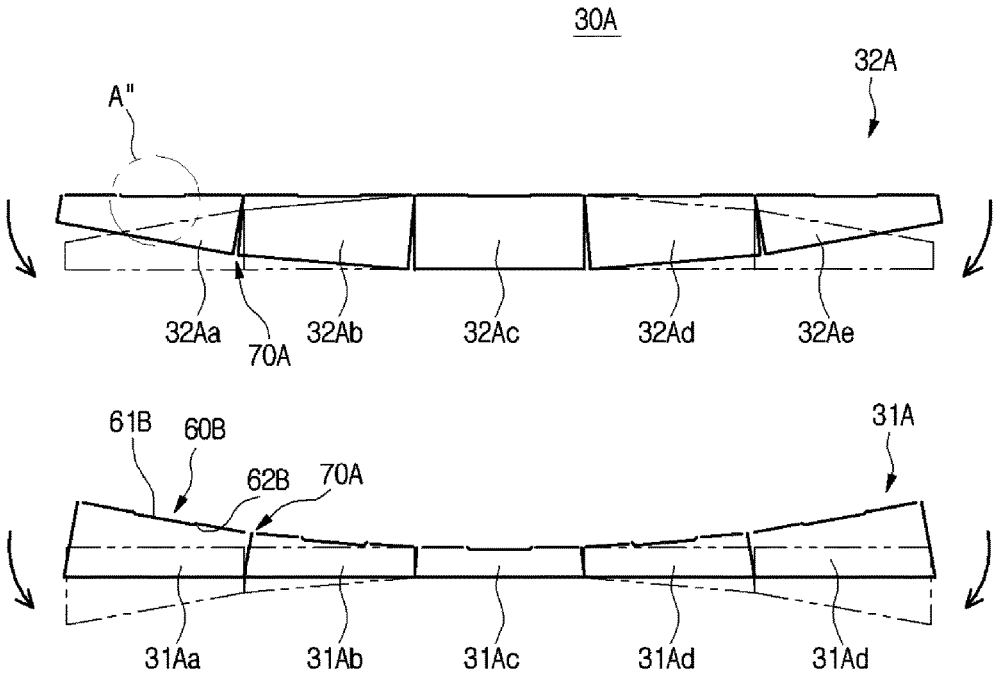
FIG. 12 is a drawing showing a movement of a lower panel unit at a time when a curvature state of a corrugated packaging box is deformed according to an exemplary embodiment.
Figure 13:
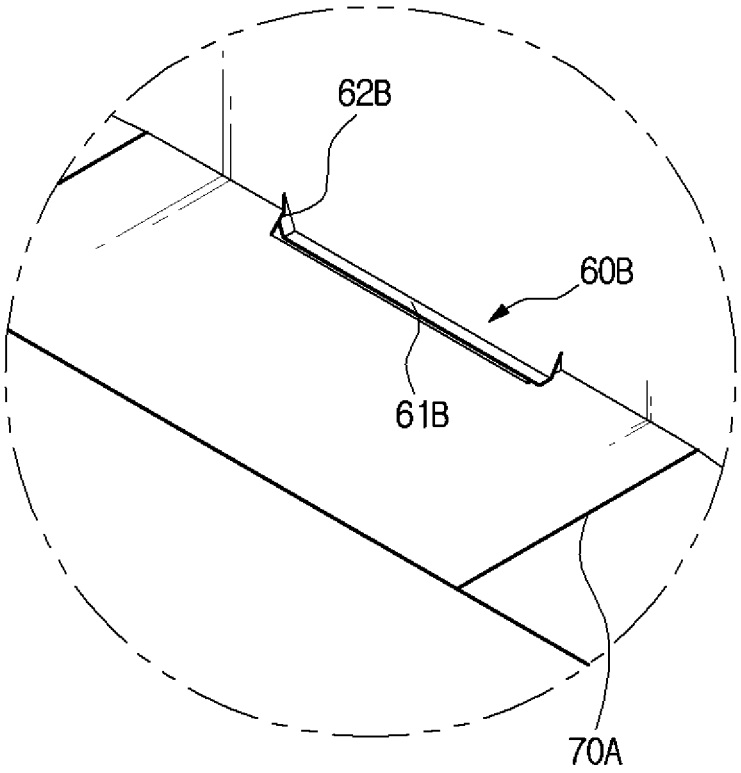
FIG. 13 is an expanded view of portion A" of FIG. 12.
Figure 14:
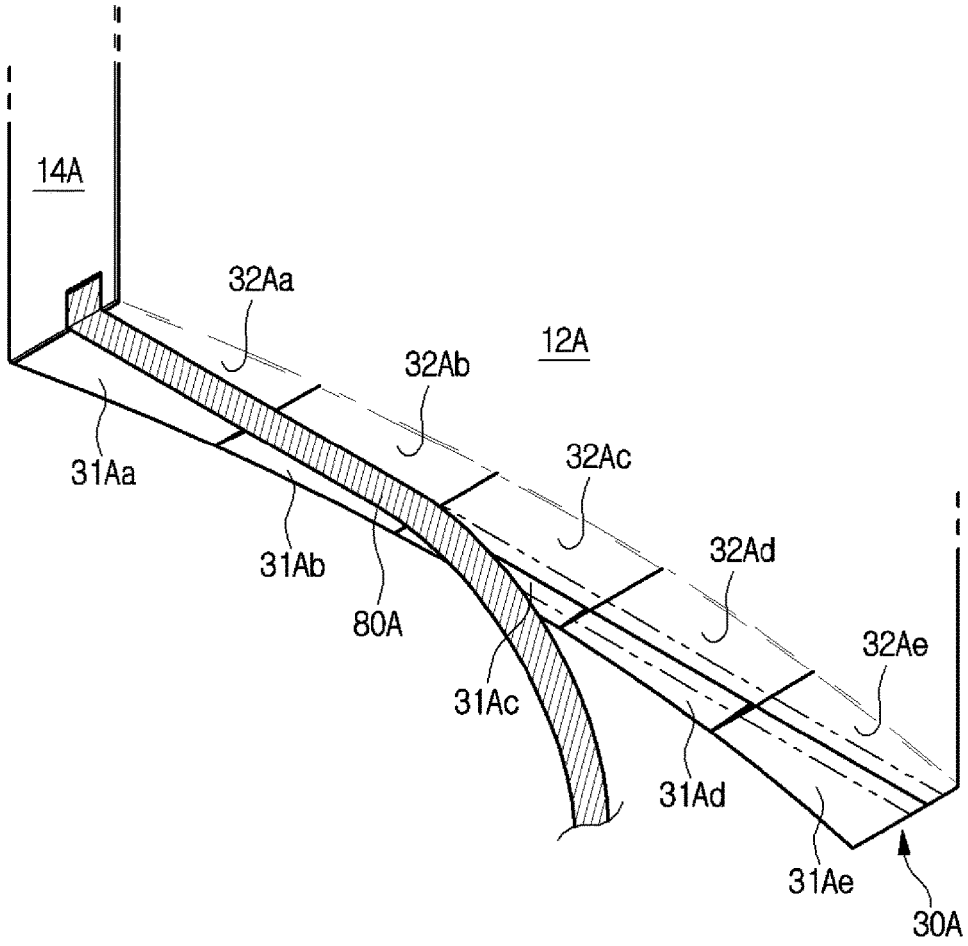
FIG. 14 is a drawing schematically showing a lower panel unit of a corrugated packaging box according to an exemplary embodiment.

FIG. 11 is a development view of a corrugated packaging box according to another exemplary embodiment. FIG. 12 is a drawing showing movement of the lower panel unit when the curvature state of the corrugated packaging box is deformed according the exemplary embodiment. FIG. 13 is an expanded view of portion A" of FIG. 12. FIG. 14 is a drawing schematically showing the lower panel unit of the corrugated packaging box according to the exemplary embodiment.

As illustrated from FIGS. 11-14, a corrugated packaging box 1A, having the curved shape, includes an upper panel unit 20A forming an upper panel, a lower panel unit 30A forming a lower panel, and a side panel unit 10A forming side panels.

An accommodation space S may be provide within the corrugated packaging box 1A. The accommodation space S is formed by the lower panel unit 30A and the side panel unit 10A. The accommodation space S has a size and shape which corresponds to the size and shape of the display apparatus 2, having the curved-shaped surface, such that the display apparatus may be accommodated therein.

The corrugated packaging box 1A is formed in the curved shape, formed as both end portions of the corrugated packaging box 1A are moved toward a middle portion of the corrugated cardboard 4.

The plurality of panel units (the upper panel unit 20A, the side panel unit 10A, and the lower panel unit 30A) of the corrugated cardboard 4 is folded by use of the creasing lines 50 to thereby form the corrugated packaging box 1A.

The side panel unit 10A of the corrugated packaging box 1A includes a first side panel 11A, a second side panel 12A configured to face the first side panel 11A, a third panel 13A disposed in between the first side panel 11A and the second side panel 12A, and a fourth side panel 14A configured to face the third side panel 13A.

In addition, a connection unit 40A, configured to connect to the fourth side panel 14A, extends from the second side panel 12A of the side panel unit 10A. The connection unit 40A extends from one side of the second side panel 12A, and is configured to make contact with an inner side of the fourth side panel 14A.

An upper side and a lower side of the side panel unit 10A are provided with the upper panel unit 20A and the lower panel unit 30A connectively formed thereto, respectively. The creasing line 50 is provided in between the side panel unit 10A and the upper panel unit 20A and in between the side panel unit 10A and the lower panel unit 30A such that the corrugated cardboard 4 may be folded.

The upper panel unit 20A, disposed at an upper side of the side panel unit 10A, includes a first upper panel 21A formed at an upper side of the first side panel 11A, a second upper panel 22A formed at an upper side of the second side panel 12A, a third upper panel 23A formed at an upper side of the third side panel 13A, and a fourth upper panel 24A formed at an upper side of the fourth side panel 14A.

The first upper panel 21A and the second upper panel 22A, formed at the upper sides of the first side panel 11A and the second side panel 12A respectively, are divided so as to formed a plurality of units.

The lower panel unit 30A, disposed at a lower side of the side panel unit 10A, includes a first lower panel 31A formed at a lower side of the first side panel 11A, a second lower panel 32A formed at a lower side of the second side panel 12A, a third lower panel 33A formed at a lower side of the third side panel 13A, and a fourth lower panel 34A formed at a lower side of the fourth side panel 14A.

The first lower panel 31A and the second lower panel 32A, formed at the lower sides of the first side panel 11A and the second side panel 12A respectively, are also divided so as to form a plurality of units.

Panels 21A, 22A, 31A, 32A are divided so that creasing of the upper panel unit 20A and the lower panel unit 30A may be prevented when deforming into the state of a curved surface by moving both end portions of the first side panel 11A and the second side panel 12A toward the middle portion of the corrugated cardboard 4.

In between the side panel unit 10A and the upper panel unit 20A, as well as in between the side panel unit 10A and the lower panel unit 30A, incision units 60A and 60B and the variation unit 70 are provided to be formed such that creasing does not occur when the corrugated cardboard 4 is deformed in the curved shape.

The side panel unit 10A, the upper panel unit 20A, the incision units 60A and 60B, and the variation unit 70 of the corrugated packaging box 1A according to the present embodiment may be identically applied as in the embodiments described above (e.g., FIGS. 4-7), and therefore the detailed descriptions of such will be omitted.

The lower panel unit 30A includes a first lower panel 31A formed at a lower side of the first side panel 11A, a second lower panel 32A formed at a lower side of the second side panel 12A, a third lower panel 33A formed at a lower side of the third side panel 13A, and a fourth lower panel 34A formed at a lower side of the fourth side panel 14A.

The first lower panel 31A and the second lower panel 32A, formed at the lower sides of the first side panel 11A and the second side panel 12A respectively, are divided to form a plurality of units. Panels 31A, 32A are divided so that creasing of the corrugated cardboard 4 may be prevented when deforming into the state of a curved surface by moving both end portions of the first side panel 11A and the second side panel 12A toward the middle portion of the corrugated cardboard 4.

The first lower panel 31A and the second lower panel 32A are formed to face each other, and may be formed in the shape to correspond with respect to each other.

The sum of the thicknesses of the first lower panel 31A and the second lower panel 32A may be identical to the thickness T of the corrugated packaging box 1A.

For example, one of the lower panels of a plurality of first lower panels 31Aa, 31Ab, 31Ac, 31Ad, and 31Ae of the first lower panel 31A, for example, the lower panel 31Aa, may have a first thickness 't1' at one end while the other end may have a second thickness 't2'. In addition, one of the lower panels of a plurality of second lower panels 32Aa, 32Ab, 32Ac, 32Ad, and 32Ae of the second lower panel 32A, for example, the lower panel 32Ae, may have a seventh thickness 't7' at one end while the other end may have an eighth thickness 't8'.

The sum of the first thickness t1 of the lower panel 31Aa and the corresponding seventh thickness t7 of the lower panel 32Ae, or the sum of the second thickness t2 and the eighth thickness t8, is identical to the thickness t of the corrugated packaging box 1A.

Similarly, one end of another lower panel 31Ab of the plurality of first lower panels 31A may have a second thickness t2 while the other end may have a third thickness t3. In addition, one end of the another lower panel 32Ad of the plurality of second lower panels 32A, may have a eighth thickness t8 while the other end may have a ninth thickness t9.

The sum of the second thickness t2 of the lower panel 31Ab and the eighth thickness t8 of the corresponding lower panel 32Ad, or the sum of the second thickness t3 and the ninth thickness t9 is identical to the thickness t of the corrugated packaging box 1A.

Therefore, each panel of the plurality of lower panels 31Aa, 31Ab, 31Ac, 31Ad, and 31Ae of the first panel 31A has a different thickness, and each panel of the plurality of lower panels 32Aa, 32Ab, 32Ac, 32Ad, and 32Ae of the second lower panel 32A has a different thickness.

Thus, the sum of the thickness of the plurality of lower panels 31Aa, 31Ab, 31Ac, 31Ad, and 31Ae of the first panel 31A and the corresponding thickness of the plurality of lower panels 32Aa, 32Ab, 32Ac, 32Ad, and 32Ae of the second lower panel 32A may be identical to the thickness t of the corrugated packaging box 1A.

Therefore, the bottom panel of the corrugated packaging box 1A is formed by use of the first lower panel 31A, and the second lower panel 32A corresponding to the first lower panel 31A.

The incision unit 60A may be disposed at the creasing line 50 in between the side panel unit 10A and the upper panel unit 20A.

In addition, the incision unit 60A may include a deformation guiding unit 60B disposed at the creasing line 50 in between the side panel unit 10A and the lower panel unit 30A.

The incision unit 60A may be disposed at a connection portion of each of the plurality of first upper panels 21A and the plurality of second upper panels 22A forming the upper panel unit 20A. That is, the incision unit 60A may be disposed in between a certain one upper panel of the first upper panels 21A, for example, the upper panel 21Aa, and another upper panel of the first upper panels 21A, for example, the upper panel 21Ab, which is adjacent to the upper panel 21Aa.

At this time, the incision unit 60A includes a first incision unit 61A formed at the creasing line 50 in between the first side panel 11A and the first upper panel 21A in the direction of the corrugation 4*c* of the corrugated cardboard 4, and a second incision unit 62A inclinedly and extendedly formed at both end portions of the first incision unit 61A.

The second incision unit 62A is formed such that bursting of the corrugated cardboard 4 does not occur at the time of deforming the corrugated cardboard 4 into the curved shape.

In addition, the upper panel unit 20A, having the plurality of upper panels 21A and 22A, includes a variation unit 70A provided to vary the distance in between the plurality of upper panels 21A and 22A when the corrugated cardboard 4 is deformed into the curved shape.

The variation unit 70A may be formed in between the plurality of upper panels 22A and the plurality of lower panels 32A. For example, the variation unit 70A may be formed in between a certain one upper panel, for example, the upper panel 22Aa of the plurality of upper panels 22A, and another upper panel, for example, the upper panel 22Ab of the plurality of upper panels 22A, which is adjacent to the upper panel 22Aa, and in between a certain one lower panel, for example, the lower panel 32Aa of the plurality of lower panels 32A, and another lower panel, for example, the lower panel 32Ab of the plurality of lower panels 32A, which is adjacent to the lower panel 32Aa.

The incision unit 60A may be formed while disposed at an identical position at which the variation unit 70A is formed.

The deformation guiding unit 60B may be formed at the creasing line 50 in between the side panel unit 10A and the lower panel unit 30A.

The deformation guiding unit 60B is provided such that bursting of the corrugated cardboard 4 does not occur when the corrugated cardboard 4 is deformed into the curved shape. The deformation guiding unit 60B includes a first deformation guiding unit 61B formed in a corrugation direction of the corrugated cardboard 4, and a second deformation guiding unit 62B inclinedly and extendedly formed at both end portions of the first deformation guiding unit 61B.

The second deformation guiding unit 62B is formed such that bursting of the corrugated cardboard 4 does not occur when the corrugated cardboard 4 is deformed into the curved shape.

The deformation guiding unit 60B may be formed such that the deformation guiding unit 60B is alternatively disposed with respect to the variation unit 70A.

The deformation guiding unit 60B is formed to coincided with the creasing line 50 formed in between the side panel unit 10A and the plurality of lower panels 31A and 32A of the lower panel unit 30A.

Meanwhile, the first lower panel 31A of the lower panel unit 30A and the second lower panel 32A facing the first lower panel 31A are provided such that the outer side of a central portion of the first lower panel 31A and the second lower panel 32A may be fixedly wrapped by use of a fixing member 80A such as a tape.

Figure 15:
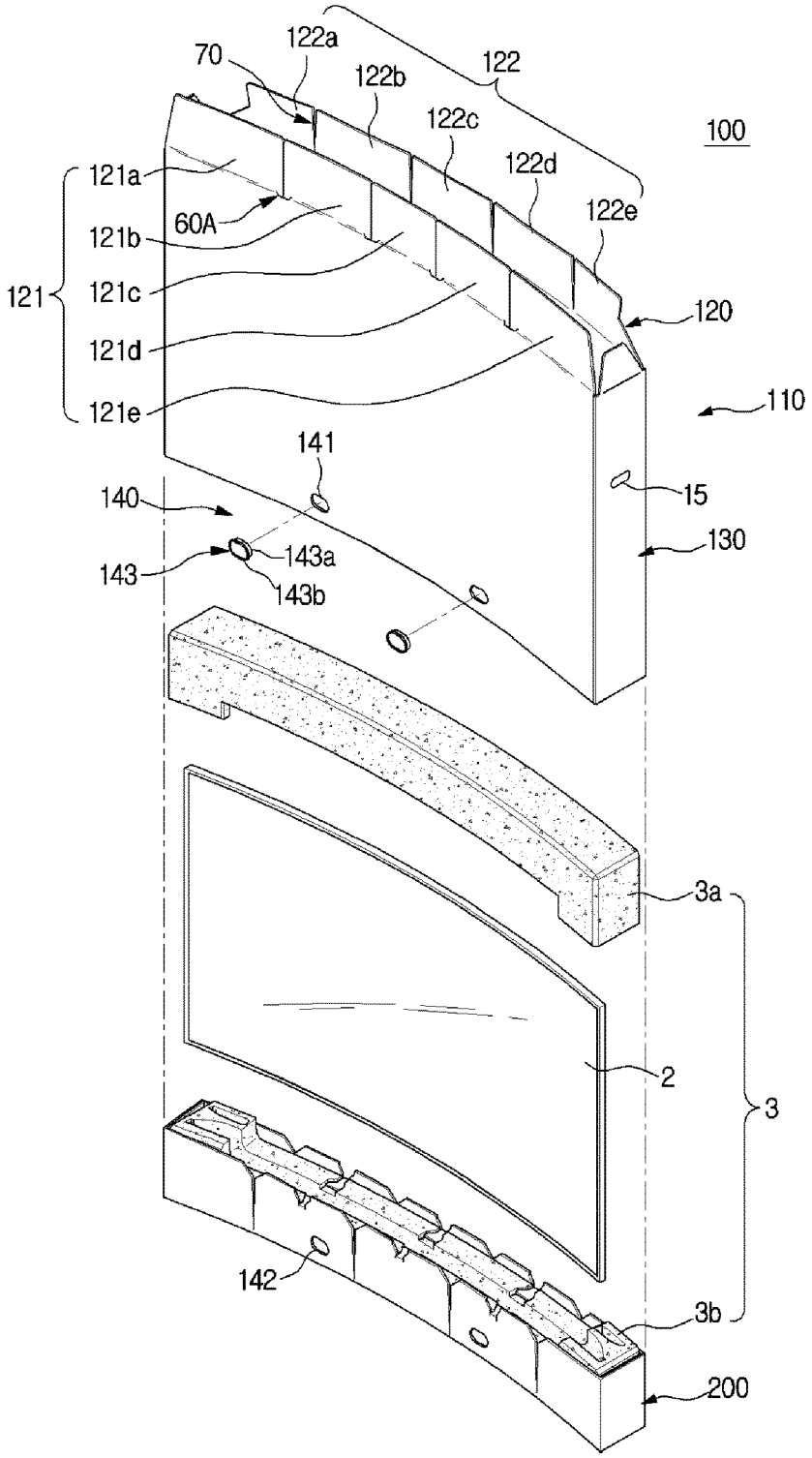
FIG. 15 is an exploded perspective view showing a display apparatus having a curved surface being packaged into a corrugated packaging box according to an exemplary embodiment.
Figure 16:
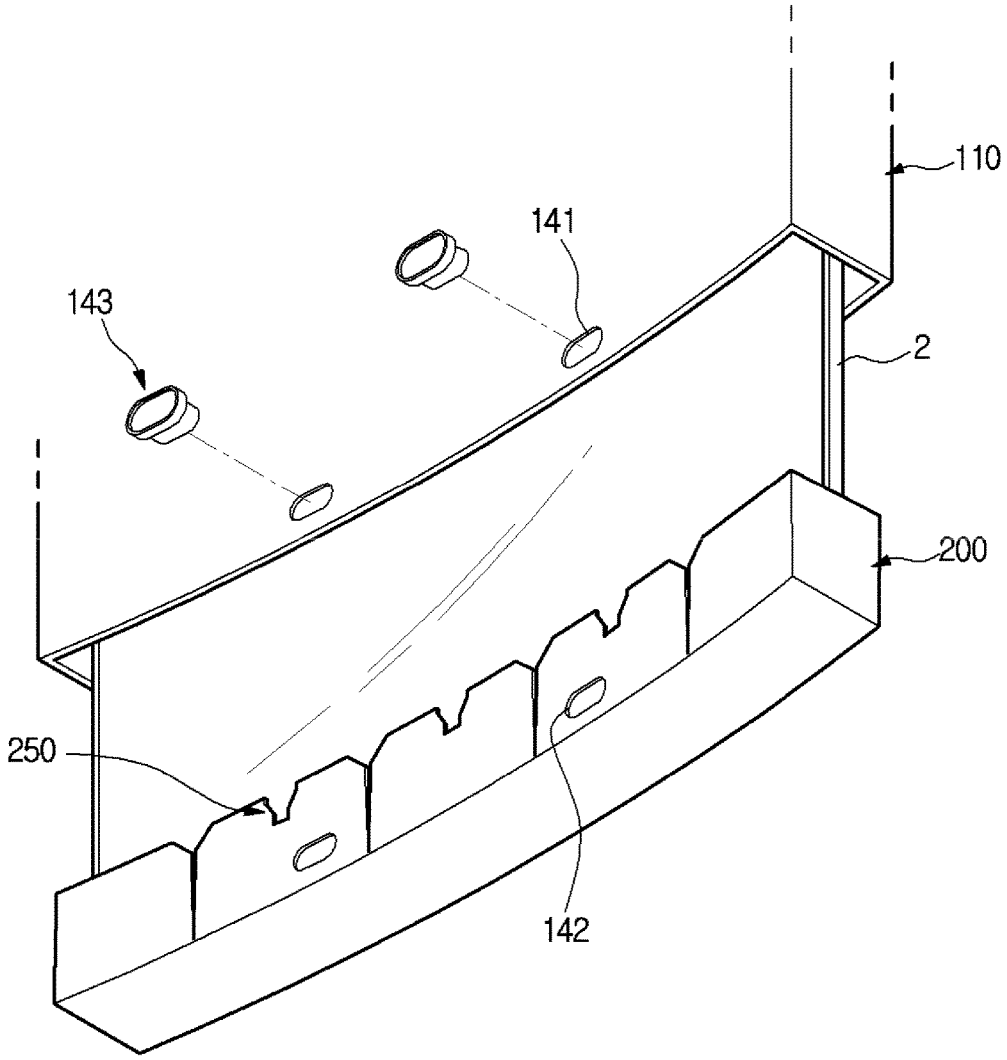
FIG. 16 is a development view showing fixation units of a first box and a second box of a corrugated packaging box according to an exemplary embodiment.
Figure 17:
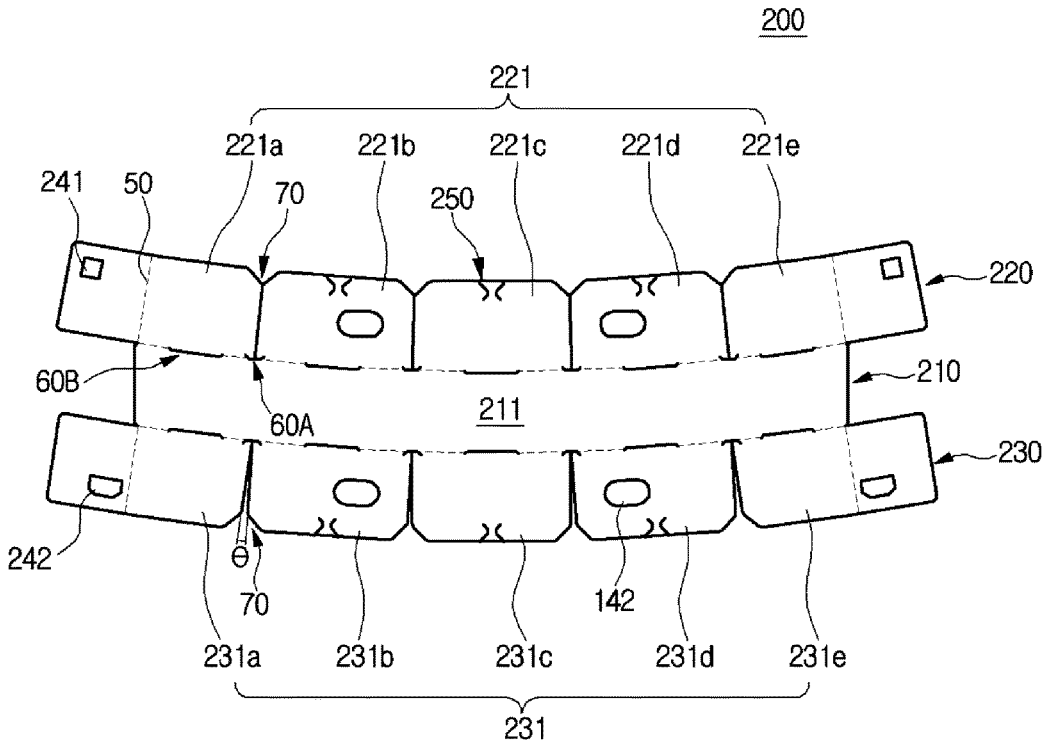
FIG. 17 is a development view of a second box of a corrugated packaging box according to an exemplary embodiment.
Figure 18:
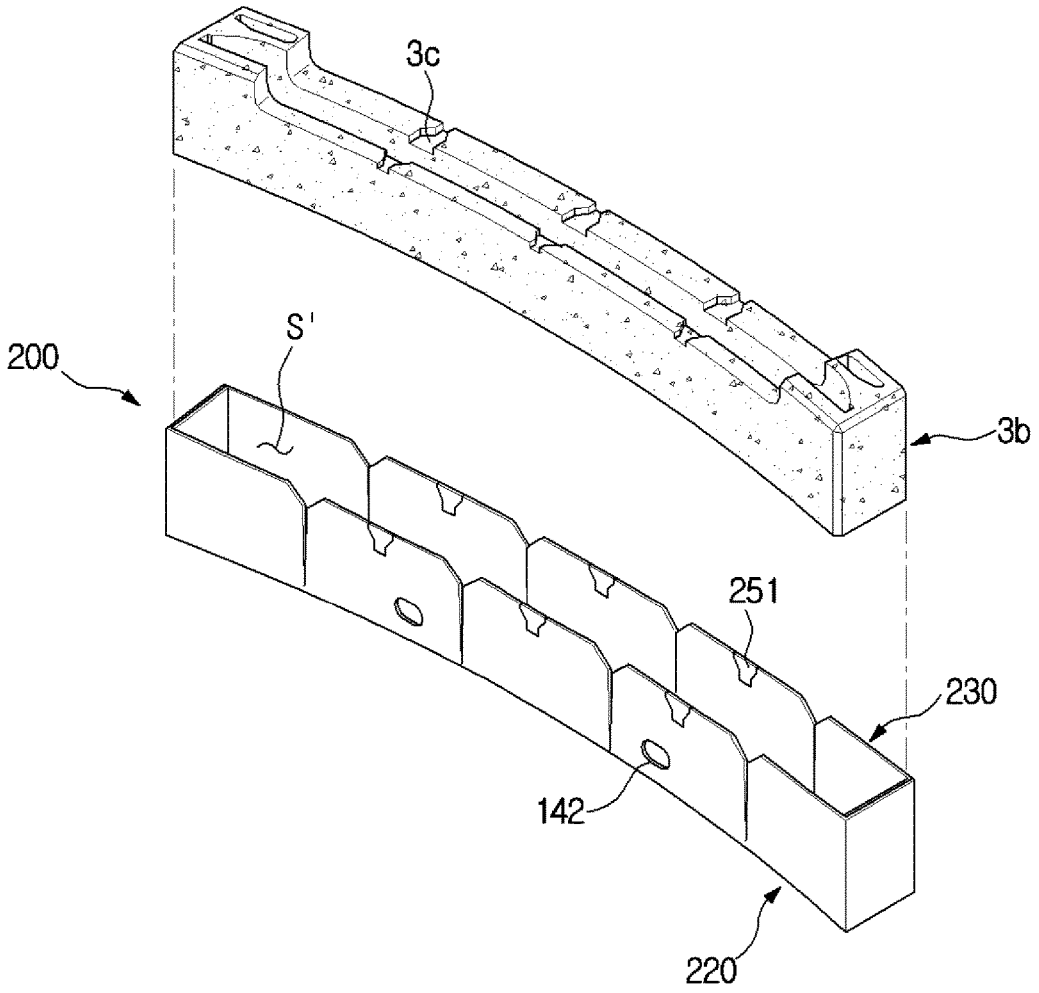
FIG. 18 is an exploded perspective view schematically showing a second box and a cushion member of a corrugated packaging box according to an exemplary embodiment.
Figure 19:
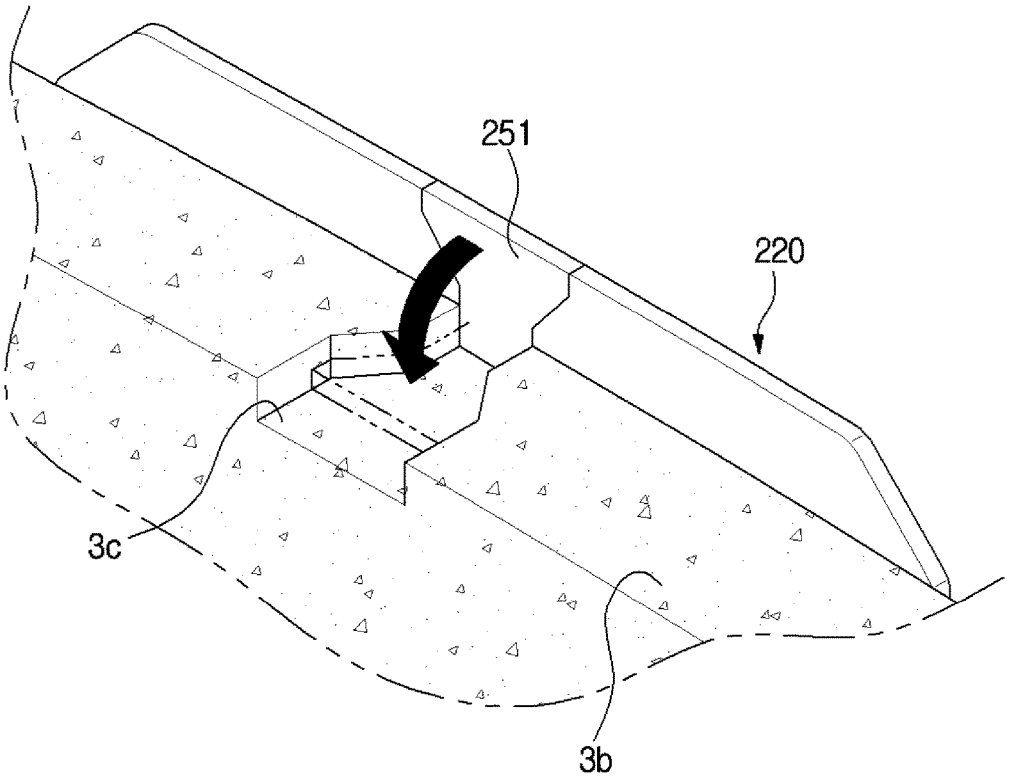
FIG. 19 is a drawing showing a coupling unit of a second box and a cushion member provided for deformation of a curvature shape of a corrugated packaging box according to an exemplary embodiment.

FIG. 15 is a drawing showing a display apparatus having the curve-shaped surface being packaged in the corrugated packaging box according to another exemplary embodiment. FIG. 16 is a drawing showing fixation units of a first box and a second box of the corrugated packaging box according to another exemplary embodiment. FIG. 17 is a development view of a second box of a corrugated packaging box according to still another exemplary embodiment. FIG. 18 is an exploded perspective view schematically showing a second box and a cushion member of a corrugated packaging box according to still another exemplary embodiment. FIG. 19 is a drawing showing a coupling unit of the second box and the cushion unit provided for the deformation of the curvature shape of the corrugated packaging box according to still another exemplary embodiment.

As illustrated from FIGS. 15-19, a corrugated packaging box 100 having the curved shape according to still another exemplary embodiment includes a first box 110 provided to form an upper portion, and a second box 200 provided to form a lower portion.

The first box 110 includes a side panel unit 130 and an upper panel unit 120.

The second box 200 includes a portion of a side panel and a lower panel of the corrugated packaging box 100.

The first box 110 is configured to be detachably fixed with respect to the second box 200. The first box 110 and the second box 200 may be connected by use of a fixation unit 140.

The first box 110 and the second box 200 include a plurality of panel units. The plurality of panels of the corrugated cardboard 4 is provided to be folded by use of the creasing lines 50.

The direction of the corrugation 4*c* of the corrugated cardboard 4 is provided to be formed in an identical direction with respect to the horizontal direction X of the corrugated packaging box 100.

A variation unit 70 and an incision unit 60A configured to form the curved shape by use of the side panel unit 130 and the upper panel unit 120 may be included.

A forming of the first box 110 in the curved shape by including the above-described structures is identical to the structures and the procedures of the above embodiments (e.g., FIGS. 4-14), and therefore the overlapping descriptions will be omitted.

A portion of the side panel unit 130 of the first box 110 may be provided with the fixation unit 140 configured to connect the first box 110 and the second box 200.

The fixation unit 140 includes a first fixation hole 141 formed at the first box 110, a second fixation hole 142 formed at the second box 200, and a fixing member 143 provided to penetratively fix the first fixation hole 141 and the second fixation hole 142.

The fixing member 143 may include a fixing bump 143*a* formed to be inserted into the second fixation hole 142, and a supporting base 143*b* extending outwardly from the fixing bump 143*a*.

The first fixation hole 141 may be provided in a plurality of units, and may be spaced apart with respect to each fixation hole 141.

An inside of the second box 200 detachably connected to the first box 110 by use of the fixing member 143 is provided with an accommodation space S' formed to correspond in size and shape such that the display apparatus 2, having the curve-shaped surface, may be accommodated therein.

The accommodation space S' is provided with a cushion member 3 configured to support the display apparatus 2.

The cushion member 3 may be provided with a first cushion member 3*a* configured to support the upper panel unit of the display apparatus 2, and a second cushion member 3*b* configured to support the lower panel unit of the display apparatus 2.

Among other materials, the cushion member 3 may include Styrofoam material formed as to absorb vibration and impact that are generally occurred while transporting. The cushion member 3 may be formed in the curved shape by a method of an injection molding.

The second cushion member 3*b* is disposed inside the second box 200, and the first cushion member 3*a* is disposed inside the first box 110.

The second fixation hole 142 may be formed at a front panel unit 220 and a rear panel unit 230 of the second box 200, both of which are to be described later.

The second box 200 may include a bottom unit 210 forming a bottom of the corrugated packaging box 100, the front panel unit 220 forming a front panel, and the rear panel unit 230 forming a rear panel.

The second box 200 is provided with an open upper panel, and is formed in the curved shape while both end portions of the second box 200 are moved toward a middle portion of the corrugated cardboard 4.

An accommodation space S' may be provide within the second box 200. The accommodation space S' is formed by the bottom unit 210, the front panel unit 220, and the rear panel unit 230. The accommodation space S' has a size and shape which corresponds to the size and shape of the display apparatus 2, having the curve-shaped surface, such that the display apparatus may be accommodated therein.

The accommodation space S' is provided with a second cushion member 3*b* and the display apparatus 2 is supported by use of a second cushion member 3*b*.

The second box 200 is formed by including a plurality of panel units, and the plurality of panel units is provided to form the curved shape while folded by use of the creasing lines 50.

The second box 200 includes the bottom unit 210 structured with a single bottom panel 211 formed in the curved shape, the front panel unit 220 extendedly formed in a front of the bottom panel 211, and the rear panel unit 230 extendedly formed toward a rear of the bottom panel 211.

The front panel unit 220 and the rear panel unit 230 are divided so as to form a plurality of units. The front panel unit 220 includes the plurality of front panels 221. The plurality of front panels 221 includes a first front panel 221*a*, a second front panel 221*b* disposed near the first front panel 221*a*, a third front panel 221*c* disposed near the second front panel 221*b*, a fourth front panel 221*d* disposed near the third front panel 221*c*, and a fifth front panel 221*e* disposed near the fourth front panel 221*d*.

In addition, the rear panel unit 230 includes a plurality of rear panels 231. The plurality of rear panels 231 includes a rear front panel 231*a*, a second rear panel 231*b* disposed near the first rear panel 231*a*, a third rear panel 231*c* disposed near the second rear panel 231*b*, a fourth rear panel 231*d* disposed near the third rear panel 231*c*, and a fifth rear panel 231*e* disposed near the fourth rear panel 231*d*.

The incision unit 60A and the variation unit 70 are provided in between from the first front panel 221*a* to the fifth front panel 221*e*, as well as in between from the first rear panel 231*a* to the fifth rear panel 231*e*.

The incision unit 60A and the variation unit 70 may be provided in a plurality of units.

Meanwhile, a connection bump 241 is formed at the first front panel 221*a* and the fifth front panel 221*e*, and a connection groove 242 corresponding to the connection bump 241 is formed at the first rear panel 231*a* and the fifth rear panel 231*e*.

The connection bump 241 of the first front panel 221*a* is coupled to the connection groove 242 of the first rear panel 231*a*, and the connection bump 241 of the fifth front panel 221*e* is coupled to the connection groove 232 of the fifth rear panel 231*e*.

At least a portion of the first front panel 221*a* and the first rear panel 231*a* and at least a portion of the fifth front panel 221*e* and the fifth rear panel 231*e* are configured to connect the front panel unit 220 and the rear panel unit 230.

Meanwhile, the second cushion member 3*b* provided as to correspond to the accommodation space S' of the second box 200 may further include an assembly unit 250 provided as to detachably connect with respect to the second box 200.

The second cushion member 3*b* is formed in the curved shape corresponding to the bottom panel 211 of the second box 200.

The assembly unit 250, by fixing the second box 200 at the second cushion member 3*b*, is provided to solidify the curved shape of the second box 200.

The assembly unit 250 includes an assembly groove 3*c* formed at an upper panel of the second cushion member 3*b*, and an assembly bump 251 formed at each of the front panel unit 220 and the rear panel unit 230 of the second box 200 at a position corresponding to the assembly groove 3*c*.

The assembly bump 251 in the present embodiment is formed at the end portion of each of the front panels from the second front panel 221*b* to the fourth front panel 221*d* of the front panel unit 220 and at the end portion of each of the rear panels from the rear panels from the second rear panel 231*b* to the fourth rear panel 231*d* of the rear panel unit 230, and the assembly groove 3*c* corresponding to the assembly bump 251 is formed, six times, in an upper panel of the second cushion member 3*b* while spaced apart by a certain distance with respect to each other, but the aspect of the present disclosure is not limited hereto. For example, the assembly bump and the assembly groove may be deformed according to the size of the display apparatus.

Meanwhile, the assembly bump 251 formed in the curved shape at each of the front panel unit 220 and the rear panel unit 230 of the second box 200 is inserted toward the assembly groove 3*c* formed at the second cushion member 3*c* at an inside of the accommodation space S', so as to hold the second box 200 in the curved shape.

With the second box 200 stably formed in the curved shape by use of the second cushion member 3*c*, the second box 200 may be detachably coupled to the first box 110 through the fixing member 143, and may easily package the display apparatus 2 having the curved-shape surface.

Figure 20:
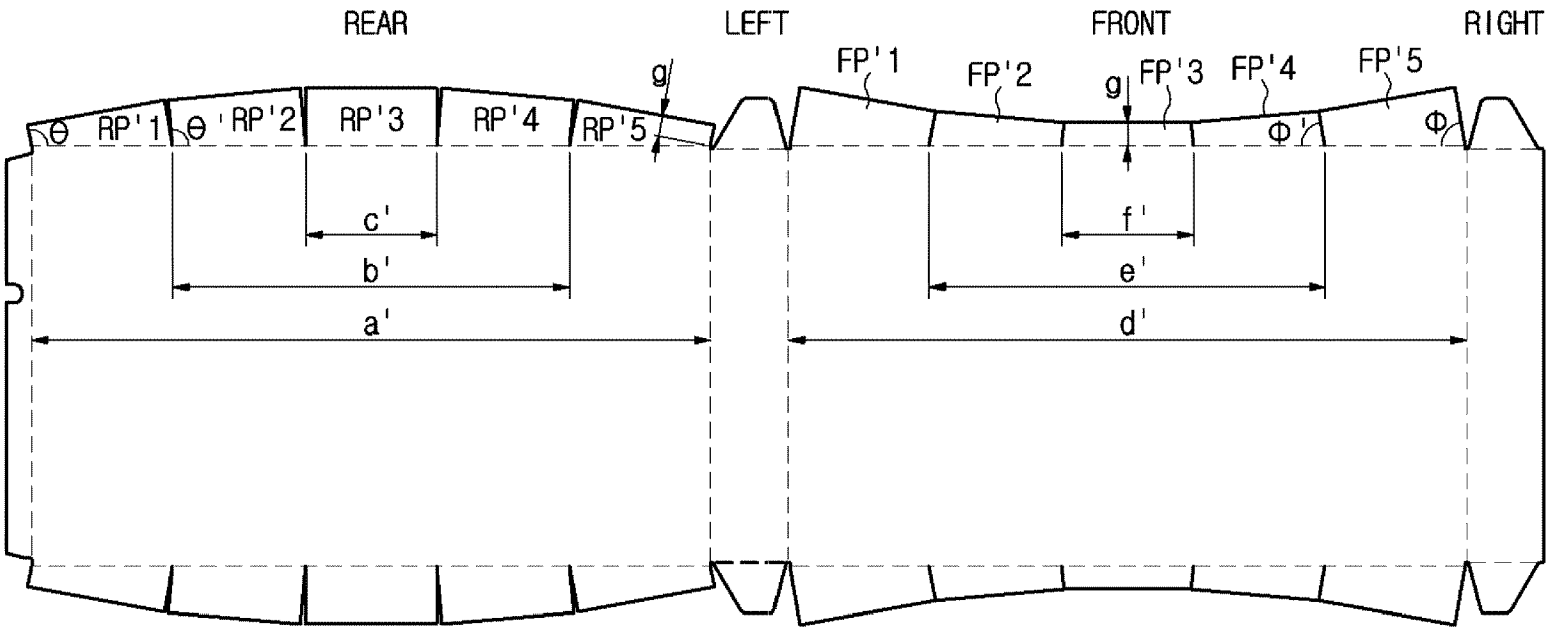
FIG. 20 is a development view of a corrugated packaging box having a particular curvature according to an exemplary embodiment.
Figure 21:
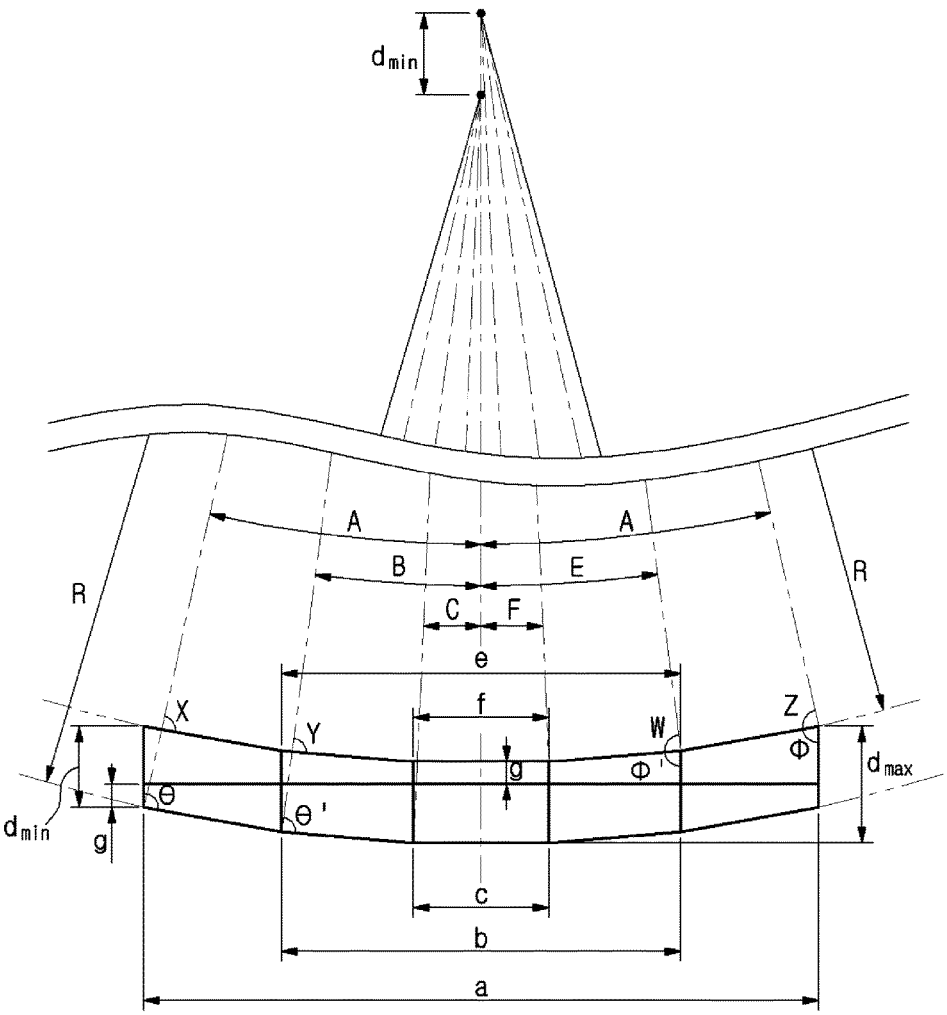
FIG. 21 is a development view showing a front panel and a rear panel disposed at a rear of a corrugated packaging box having a particular curvature according to an exemplary embodiment.

FIG. 20 and FIG. 21 are development views of the corrugated packaging box having a particular curvature according to still another exemplary embodiment.

As illustrated on FIG. 20 and FIG. 21, a corrugated packaging box according to an exemplary embodiment may include a formula having a particular curvature such that the front panel FP and the rear panel RP are provided to meet each other when the divided upper panels are folded.

The corrugated packaging box 1 may include a front panel FP', which is divided, and a rear panel RP' corresponding to the front panel FP'. The front panel FP' of the present embodiment is divided into five units, and includes a first front panel FP'1, a second front panel FP'2, a third front panel FP'3, a fourth front panel FP'4, and a fifth front panel FP'5, and the rear panel RP' is also divided into five units, and includes a first rear panel RP'1, a second rear panel RP'2, a third rear panel RP'3, a fourth rear panel RP'4, and a fifth rear panel RP'5, but the aspect of the present disclosure is not limited hereto. For example, the division of the front panel and the rear panel may be changed according to the size of the corrugated packaging box.

Meanwhile, the width of the corrugated packaging box 1 is referred to as a, the length of the front panel FP and the rear panel RP is referred to as a', the distance between flaps between the respective divided rear panels RP is referred to as b or c, the length of the flaps of the rear panel RP is referred to as b' or c', the distance between flaps between the respective divided front panels FP is referred to as e, and the length of flaps of the front panel FP is referred to as e'.

The angle of the rear panel RP is referred to as θ, which is an angle of the flaps of the rear panel, and the angle of the front panel FP is referred to as Φ, which is an angle of the flaps of the front panel FP.

The number of the divided front panel is referred to as n, which is the number of flaps, the height of the divided front panels is referred to as 'h', which is the height of the flap, and the angle between the front panel is referred to as e, which is the distance between the flaps.

In addition, assuming that the minimum depth of the corrugated packaging box 1 is referred to as d_min (minimum depth of box) and the maximum depth of the corrugated packaging box 1 is referred to as d_max (maximum depth of box), the above may be established as to satisfy the following Formula (2):

[Formula (2)]

$$A = \cos^{-1}\left(\frac{\sqrt{R^2 - \left(\frac{a}{2}\right)^2}}{R}\right),\ B = \cos^{-1}\left(\frac{\sqrt{R^2 - \left(\frac{b}{2}\right)^2}}{R}\right),$$

$$C = \cos^{-1}\left(\frac{\sqrt{R^2 - \left(\frac{c}{2}\right)^2}}{R}\right),\ E = \cos^{-1}\left(\frac{\sqrt{R^2 - \left(\frac{e}{2}\right)^2}}{R}\right),$$

$$F = \cos^{-1}\left(\frac{\sqrt{R^2 - \left(\frac{f}{2}\right)^2}}{R}\right)$$

-continued $$\Phi = \pi - (Z + A) = \pi - \left[\frac{\pi - (A - E)}{2} + A\right] = \frac{\pi - (A + E)}{2}$$

$$\Phi' = \pi - (W + E) = \pi - \left[\frac{\pi - (E - F)}{2} + E\right] = \frac{\pi - (E + F)}{2}$$

$$a' = f \times 2A$$

$$b' = b \times 2B$$

$$c' = c \times 2C$$

$$e' = e \times 2E$$

$$f' = f \times 2F$$

$$g = d_{min} - \frac{d_{max}}{2}$$

$$d_{max} = d_{min} + r(1 - \cos A)$$

The divided front panel FP and the rear panel RP having the curvature formed by use of the figures that satisfy the above-described Formula (2) are provided such that the cutting lines L1 may meet each other when divided front panel The front panel FP and the rear panel RP are folded while having the creasing lines L2 as references. Therefore, at the same time when a curved surface formed by use of the particular curvature, the front panel FP and the rear panel RP are provided to correspondingly meet each other.

Therefore, the corrugated packaging box 1 is provided to form the shape of a packaging box while maintaining the curved shape as the front panel FP and the rear panel RP are provided to correspondingly meet each other.

As should be apparent from the disclosure above, as a corrugation direction of a corrugated cardboard is provided to be parallel to the horizontal direction of a corrugated packaging box, the strength of the corrugated packaging box may be enhanced.

In addition, by including a curved surface corresponding to a curved shape of an electronic product, such as a display apparatus, a toy, a computer, or other smart apparatus, the shape of the product may be acknowledged and reflected in the corrugated packaging box such that the corrugated packaging box conforms to the curved shape of the electronic product.

In addition, the packaging space may be minimized as the corrugated box packaging conforms to the shape of a product.

In addition, protection of the electronic product may be provided when the flaps are covered by implementing a corrugated packaging box having the curved shape of a particular curvature of the electronic product.

Although a few exemplary embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A packaging box formed of corrugated cardboard, the packaging box comprising:

an upper panel unit comprising a plurality of upper panels;

a lower panel unit comprising a plurality of lower panels;

a side panel unit comprising a plurality of side panels; and at least one incision unit configured to prevent damage to a boundary of a portion of the packaging box, wherein the upper panel unit is divided into the upper panels and the lower panel unit is divided into the lower panels such that both end portions of the packaging box are protruded outwardly relative to a middle portion of the packaging box to form a curved shape, and wherein the at least one incision unit comprises:

a first incision unit formed in a corrugation direction of the corrugated cardboard; and a second incision unit extending from end portions of the first incision unit and by a creasing line between a first side panel from among the plurality of side panels and at least one panel from among the plurality of upper panels and the plurality of lower panels.

2. The packaging box of claim 1, further comprising a plurality of panel units configured to be connected to one another, wherein the plurality of panel units comprises:

the side panel unit forming side panels of the packaging box;

the upper panel unit formed at one side of the side panel unit so as to form an upper panel of the packaging box;

the lower panel unit formed at an other side of the side panel unit so as to form a lower panel of the packaging box; and a connection unit formed on at least one of the side panels and configured to be connected to another one of the side panels.

3. The packaging box of claim 2, wherein the at least one incision unit further comprises a plurality of incision units provided between the side panel unit and the upper panel unit, and between the side panel unit and the lower panel unit.

4. The packaging box of claim 3, wherein the plurality of incision units further comprise a plurality of second incision units formed extendedly and inclinedly from both end portions of the first incision unit.

5. The packaging box of claim 2, wherein each of the upper panel unit and the lower panel unit is divided into a plurality of panels.

6. The packaging box of claim 5, further comprising a variation unit configured to vary a distance between the plurality of panels of the upper panel unit and a distance between the plurality of panels of the lower panel unit when a curvature of the corrugated cardboard is deformed.

7. The packaging box of claim 6, wherein the variation unit is configured to vary an angle between two adjacent panels of the plurality of panels of the upper panel unit.

8. The packaging box of claim 6, wherein the variation unit is configured to vary an angle between two adjacent panels of the plurality of panels of the lower panel unit.

9. The packaging box of claim 5, wherein the plurality of panels of the upper panel unit and the plurality of panels of the lower panel unit are configured to overlap one another when a curvature of the packaging box is deformed.

10. The packaging box of claim 9, wherein each of the upper panel unit and the lower panel unit comprises a creasing line and a cutting line that are configured to meet each other when foldedly deformed while having the creasing line as a center.

11. The packaging box of claim 1, further comprising:

a first box configured to form an upper portion of the packaging box, and a second box detachably provided at a lower side of the first box, and a fixation unit configured to connect the first box and the second box.

12. The packaging box of claim 11, wherein the fixation unit comprises:

a first fixation hole formed in the first box, a second fixation hole formed in the second box, and a fixing member configured to penetrate the first fixation hole and the second fixation hole.

13. The packaging box of claim 11, further comprising a cushion member configured to be disposed within the second box, wherein the cushion member has a curved shape, and wherein the second box comprises an assembly unit configured to connect the second box to the cushion member.

14. A packaging box comprising a plurality of panel units formed of corrugated cardboard comprising a pair of cardboards and a corrugating medium providing corrugation in between the pair of cardboards, wherein the plurality of panel units are connected to each other and configured to be assembled by folding, wherein a part of the plurality of panel units is deformed into a curved shape in which both end portions of the packaging box are protruded outwardly relative to a middle portion of the packaging box, wherein a corrugation direction of the corrugating medium is parallel to a longitudinal direction of the packaging box, wherein the plurality of panel units comprise:

a side panel unit comprising a plurality of side panels, an upper panel unit comprising a plurality of upper panels;

a lower panel unit comprising a plurality of lower panels; and at least one incision unit formed between the side panel unit and the upper panel unit and between the side panel unit and the lower panel unit in a corrugation direction of the corrugated cardboard, wherein the at least one incision unit comprises:

a first incision unit formed in the corrugation direction of the corrugated cardboard; and a second incision unit extending from end portions of the first incision unit and by a creasing line between a first side panel from among the plurality of side panels and at least one panel from among the plurality of upper panels and the plurality of lower panels.

15. The packaging box of claim 14, wherein the plurality of panel units of the corrugated cardboard comprises:

the side panel unit having the plurality of side panels configured to form side panels of the packaging box;

the upper panel unit comprising a plurality of panels dividedly configured to form an upper panel of the packaging box;

the lower panel unit comprising a plurality of panels dividedly configured to form a lower panel of the packaging box; and a connection unit formed on at least one of the side panels and configured to be connected to another one of the side panels.

16. The packaging box of claim 15, wherein the second incision unit extends inclinedly from the end portions of the first incision unit.

17. The packaging box of claim 15, wherein the at least one incision unit further comprises a plurality of incision units provided between the side panel unit and the upper panel unit and between the side panel unit and the lower panel unit.

18. The packaging box of claim 15, further comprising a variation unit configured to, when a curvature of the corrugated cardboard is deformed, vary a distance in between the plurality of panels of the upper panel unit and a distance in between the plurality of panels of the lower panel unit.

19. The packaging box of claim 18, wherein the variation unit comprises a first variation unit configured to vary an angle in between two adjacent panels of the plurality of panels of the upper panel unit.

20. The packaging box of claim 18, wherein the variation unit comprises a second variation unit configured to vary an angle in between two adjacent panels of the plurality of panels of the lower panel unit.

21. The packaging box of claim 18, wherein the plurality of upper panels and the plurality of lower panels are configured to overlap one another when a curved surface of the packaging box is deformed.

22. The packaging box of claim 21, wherein each of the plurality of upper panels and the plurality of lower panels comprises a creasing line and a cutting line that are configured to meet each other when foldedly deformed while having the creasing line as a center.

23. The packaging box of claim 14, further comprising: a first box configured to form an upper portion of the packaging box, a second box detachably provided at a lower side of the first box, and a fixation unit configured to detachably connect the first box to the second box.

24. The packaging box of claim 23, wherein the fixation unit comprises: a first fixation hole formed in the first box, a second fixation hole formed in the second box, and a fixing member configured to penetrate the first fixation hole and the second fixation hole.

* * * * *